US007627997B2

(12) United States Patent
Messenger et al.

(10) Patent No.: US 7,627,997 B2
(45) **Date of Patent: *Dec. 8, 2009**

(54) CONCRETE FOUNDATION WALL WITH A LOW DENSITY CORE AND CARBON FIBER AND STEEL REINFORCEMENT

(75) Inventors: Harold G. Messenger, Rehoboth, MA (US); Thomas Rotondo, Harwinton, CT (US)

(73) Assignee: Oldcastle Precast, Inc., Auburn, WA (US)

( * ) Notice: Subject to any disclaimer, the term of this patent is extended or adjusted under 35 U.S.C. 154(b) by 778 days.

This patent is subject to a terminal disclaimer.

(21) Appl. No.: 11/096,705

(22) Filed: Apr. 1, 2005

(65) Prior Publication Data

US 2006/0000171 A1 Jan. 5, 2006

Related U.S. Application Data

(63) Continuation-in-part of application No. 10/772,148, filed on Feb. 3, 2004, now Pat. No. 7,100,336, which is a continuation-in-part of application No. 10/423,286, filed on Apr. 24, 2003, now Pat. No. 6,898,908, which is a continuation-in-part of application No. 10/150,465, filed on May 17, 2002, now Pat. No. 6,729,090, which is a continuation-in-part of application No. 10/093,292, filed on Mar. 6, 2002, now Pat. No. 6,701,683.

(51) Int. Cl.

| | |
|---|---|
| ***E04C 2/00*** | (2006.01) |
| ***E04C 2/26*** | (2006.01) |
| ***E04C 1/40*** | (2006.01) |
| ***E04C 1/00*** | (2006.01) |

(52) U.S. Cl. ..... 52/309.17; 52/309.16; 52/309.11; 52/309.12; 52/794.1; 52/747.1; 52/742.14; 428/158

(58) Field of Classification Search ..... 52/309.12, 52/309.16, 309.17, 251, 252, 405.3, 405.1, 52/309.11, 794.1, 745.15, 747.1, 742.14, 52/443, 449, 405.2, 407.4; 428/158–160
See application file for complete search history.

(56) References Cited

U.S. PATENT DOCUMENTS

| | | | |
|---|---|---|---|
| 890,011 | A | 6/1908 | Anderson |
| 1,229,904 | A | 6/1917 | Day |
| 1,420,246 | A | 6/1922 | Faber |
| 1,484,206 | A | 2/1924 | Birkholz |
| 1,834,892 | A | 12/1931 | Betzler |

(Continued)

FOREIGN PATENT DOCUMENTS

| | | |
|---|---|---|
| AU | 114294 | 12/1941 |

(Continued)

OTHER PUBLICATIONS

Office Action Summary for U.S. Appl. No. 11/098,001, filed Feb. 22, 2008.

(Continued)

*Primary Examiner*—Jeanette Chapman
(74) *Attorney, Agent, or Firm*—Sheridan Ross P.C.

(57) ABSTRACT

A fabricated concrete foundation wall is provided with a plurality of insulation panels and reinforcing ribs to improve strength and reduce the density of the wall panel. The foundation wall panels are easily placed and interconnected together to quickly provide a foundation adapted to support the main walls of a home, for example. The foundation panels in one embodiment generally include a facewall that may have at least one carbon fiber band positioned horizontally therethrough to provide additional stiffness.

5 Claims, 28 Drawing Sheets

U.S. PATENT DOCUMENTS 1,891,837 A 12/1932 Pittman
1,897,327 A 2/1933 Olson
2,080,618 A 5/1937 Madsen
2,312,293 A 2/1943 Weiss
3,298,152 A 1/1967 Lockshaw
3,305,991 A 2/1967 Weismann
3,484,999 A 12/1969 Van Der Lely
3,567,816 A 3/1971 Embree
3,597,890 A 8/1971 Hala
3,646,715 A 3/1972 Pope
3,775,240 A 11/1973 Harvey
3,775,916 A 12/1973 Bair
3,879,908 A 4/1975 Weismann
3,944,242 A 3/1976 Eubank
4,019,297 A 4/1977 Murphy
4,052,825 A 10/1977 Larsson
4,073,998 A 2/1978 O'Connor
4,104,842 A 8/1978 Rockstead et al.
4,125,981 A 11/1978 MacLeod et al.
4,229,497 A 10/1980 Piazza
4,232,494 A * 11/1980 Bauch et al. ..... 174/504
4,233,787 A 11/1980 Piazza
4,471,591 A * 9/1984 Jamison ..... 52/309.9
4,505,019 A 3/1985 Deinzer
4,512,126 A 4/1985 Walston
4,567,705 A 2/1986 Carlson
4,572,857 A 2/1986 Bekaert
4,611,450 A 9/1986 Chen
4,612,748 A 9/1986 Arnold et al.
4,617,219 A 10/1986 Shupack
4,632,796 A 12/1986 Moulet
4,706,430 A 11/1987 Sugita et al.
4,769,964 A * 9/1988 Johnson et al. ..... 52/405.4
4,811,770 A * 3/1989 Rapp ..... 52/309.12
4,841,702 A 6/1989 Huettemann
4,856,244 A * 8/1989 Clapp ..... 52/309.7
4,912,902 A 4/1990 Weaver
4,916,004 A 4/1990 Ensminger et al.
4,930,278 A 6/1990 Staresina et al.
4,934,121 A 6/1990 Zimmerman
4,990,390 A 2/1991 Kawasaki et al.
5,020,287 A 6/1991 Woods
5,025,605 A 6/1991 Sekijima et al.
5,032,340 A 7/1991 Akihama et al.
5,058,345 A 10/1991 Martinez
5,095,674 A 3/1992 Huettemann
5,129,203 A 7/1992 Romero
5,146,721 A 9/1992 Candiracci
5,199,233 A 4/1993 Fukutomi
5,317,848 A 6/1994 Abbey
5,398,470 A 3/1995 Ritter et al.
5,493,836 A 2/1996 Lopez-Munoz
5,493,838 A 2/1996 Ross
5,526,629 A 6/1996 Cavaness
5,596,853 A * 1/1997 Blaney et al. ..... 52/223.7
5,617,685 A 4/1997 Meier et al.
5,758,463 A 6/1998 Mancini, Jr.
5,836,715 A 11/1998 Hendrix et al.
D406,902 S 3/1999 Lockwood
5,894,003 A 4/1999 Lockwood
6,003,278 A * 12/1999 Weaver et al. ..... 52/414
D426,321 S 6/2000 Lockwood
6,088,985 A 7/2000 Clark
6,094,881 A 8/2000 Lockwood
6,101,779 A 8/2000 Davenport
6,112,489 A 9/2000 Zweig
6,131,365 A 10/2000 Crockett
6,164,035 A 12/2000 Roberts
6,170,220 B1 1/2001 Moore, Jr.
6,185,890 B1 2/2001 Ritter
6,202,375 B1 3/2001 Kleinschmidt
6,230,465 B1 5/2001 Messenger et al.
6,237,297 B1 5/2001 Paroly
6,263,629 B1 7/2001 Brown
6,272,805 B1 8/2001 Ritter et al.
6,295,786 B1 10/2001 Lee
6,324,812 B1 12/2001 Drya-Lisiecka
6,345,483 B1 2/2002 Clark
6,363,683 B1 * 4/2002 Moore, Jr. ..... 52/741.13
6,434,900 B1 8/2002 Masters
6,438,923 B2 8/2002 Miller
6,481,178 B2 11/2002 Moore, Jr.
6,609,340 B2 8/2003 Moore, Jr. et al.
6,622,444 B2 9/2003 Zarate et al.
6,631,603 B2 10/2003 Zornes
6,701,683 B2 3/2004 Messenger et al.
6,705,055 B2 3/2004 Ritter et al.
6,718,712 B1 4/2004 Heath
6,729,090 B2 5/2004 Messenger et al.
6,735,914 B2 5/2004 Konopka
7,237,366 B2 * 7/2007 Donahey et al. ..... 52/404.2
2001/0008319 A1 * 7/2001 Kistner et al. ..... 264/135
2002/0189182 A1 12/2002 Record
2003/0029107 A1 2/2003 Ritter et al.
2004/0016194 A1 1/2004 Stefanutti et al.
2004/0206032 A1 * 10/2004 Messenger et al. ..... 52/506.01
2007/0062151 A1 3/2007 Smith

FOREIGN PATENT DOCUMENTS

EP 16478 10/1980
EP 0 227 207 1/1987
GB 545526 6/1942
GB 2201175 8/1988

OTHER PUBLICATIONS

Office Action Summary for U.S. Appl. No. 11/122,267, filed Aug. 5, 2008.

* cited by examiner

Architectural Panel Center Section . . .

Architectural Panel End Section . . .

Architectural Panel End Return Section . . .

Architectural Panel Window Return Section . . .

Architectural Panel Bottom Section...

Architectural Panel Bottom Section . . .

Wall Panel Section . . .

Architectural Panel @ 3-Sided Rib Mid

Architectural Panel @ 4-Sided Mid Rib

Architectural Panel @ Bearing Pocket Seat

Architectural Panel @ Thermally Broken Closed-End Rib Joint

Architectural Panel @ Rib

Hardwall Panel @ Horizontal Joint

Wall Panel

Multi-unit Residential Wall Panel @ Middle Rib

Multi-unit Residential Panel @ End Rib

Multi-unit Residential Panel @ Corner Ribs

Multi-unit Residential Panel @ Top Rib

Multi-unit Residential Panel @ Bottom Rib

CONCRETE FOUNDATION WALL WITH A LOW DENSITY CORE AND CARBON FIBER AND STEEL REINFORCEMENT

This application is a continuation-in-part of U.S. patent application Ser. No. 10/772,148, filed Feb. 3, 2004 now U.S. Pat. No. 7,100,336, which is a continuation-in-part of U.S. patent application Ser. No. 10/423,286, filed Apr. 24, 2003 now U.S. Pat. No. 6,898,908, which is a continuation-in-part of U.S. patent application Ser. No. 10/150,465, now U.S. Pat. No. 6,729,090, filed May 17, 2002, which is a continuation-in-part of U.S. patent application Ser. No. 10/093,292, now U.S. Pat. No. 6,701,683, filed Mar. 6, 2002, each of the applications or issued patents being incorporated by reference in their entirety herein.

FIELD OF THE INVENTION

The present invention relates to building components, and more specifically lightweight concrete foundation walls that are manufactured in a controlled environment and can be selectively interconnected on-site to fabricate modular buildings.

BACKGROUND OF THE INVENTION

Due to the high cost of traditional concrete components and the expensive transportation and labor costs associated therewith, there is a significant need in the construction industry to provide lightweight, precast, composite building panels that have superior strength and insulative properties. Previous attempts to provide these types of building panels have failed due to the expensive transportation costs and less than ideal insulative and thermal conductivity properties associated with prefabricated concrete wire-reinforced products. Further, due to the brittle nature of concrete, many of the previously used building panels are prone to cracks and other damage during transportation.

The relatively large weight per square foot of building panels of the prior art has resulted in high expenses arising not only from the amount of materials needed for fabrication, but also the cost of transporting and erecting the modules. Module weight also places effective limits on the height of structures, such as stacked modules e.g., due to load limitations of the building foundations, footings and/or lowermost modules. Furthermore, there is substantial fabrication labor expense that can arise from design, material, and labor costs associated with providing and placing reinforcement materials. Accordingly, it would be useful to provide a wall panel system for modular construction that is relatively light, can be readily stacked to increased heights and, preferably, inexpensive to design, manufacture, transport and erect.

In many situations panels or modules are situated in locations where it is desirable to have openings therethrough to accommodate doorways, windows, cables, pipes and the like. In some previous approaches, panels were required to be specially designed and cast so as to include any necessary openings, requiring careful planning and design, thus increasing costs due to the special, non-standard configuration of such panels. In other approaches, panels were cast without such openings and the openings were formed after casting, e.g. by sawing or similar procedures. Such post-casting procedures such as cutting, particularly through the thick and/or steel-reinforced panels as described above, is a relatively labor-intensive and expensive process. In many processes for creating openings, there is a relatively high potential for cracking or splitting of the panel or module. Accordingly, it would be useful to provide panels and modules wherein openings such as doors and windows may be integrated in desired locations with a reduced potential for cracking or splitting.

One other problem associated with metallic wire or bar materials used in conjunction with concrete is the varying rates of expansion and contraction. Thus, with extreme heating and cooling the embedded metallic materials tend to separate from the concrete, thus creating cracks which may lead to exposure to moisture and the eventual degradation of both the concrete and wire reinforcement due to corrosion.

One example of a composite building panel that attempts to resolve the aforementioned problems inherent in modular panel construction of the prior art is described in U.S. Pat. No. 6,202,375 to Kleinschmidt (the '375 patent), which is incorporated by reference in its entirety herein. In this invention, a building system is provided that utilizes an insulative core with an interior and exterior sheet of concrete and which is held together with a metallic wire mesh positioned on both sides of an insulative core. The wire mesh is embedded in concrete, and held together by a plurality of metallic wires extending through the insulative core at a right angle to the longitudinal plane of the insulative core and concrete panels. Although providing an advantage over homogenous concrete panels, the composite panel disclosed in the '375 patent does not provide the necessary strength and stiffness properties required during transportation and in high wind environments. Further, the metallic wire mesh materials are susceptible to corrosion when exposed to water during fabrication, and have poor insulative qualities due to the high heat transfer properties of metallic wire. Thus, the panels disclosed in the '375 patent may be more susceptible to failure when exposed to stresses during transportation, assembly or subsequent use.

In addition, attempts have been made to employ improved building materials that incorporate carbon fiber. For example, in U.S. Pat. No. 6,230,465 to Messenger, et al., which is incorporated herein in its entirety by reference, discloses concrete with a carbon fiber and steel reinforced precast frame. Unfortunately, the insulative properties of this invention are relatively poor due to the physical nature of the concrete and steel. Further, the excessive weight of the panels and inherent problems associated with transportation, stacking, etc. are present. Previously known prefabricated building panels have also not been found to have sufficient tensile and compressive strength when utilizing only concrete insulative foam materials or wire mesh. Thus, there is a significant need for a lightweight concrete building panel that has increased tensile and compressive strength, and which utilizes one or more commonly known building materials to achieve this purpose.

Furthermore, there is a need for a precast concrete foundation wall system that can be directly positioned on a prepared soil gravel or sand surface and interconnected to one or more foundation walls. After interconnection, a concrete floor can be poured which is operatively interconnected to the foundation walls and provides additional support.

Accordingly, there is a significant need in the construction and building industry to provide a composite building panel and foundation wall that may be used in modular construction and which is lightweight, provides superior strength and has high insulative values. Further, a method of making these types of building panels is needed that is inexpensive, utilizes commonly known manufacturing equipment, and which can be used to mass produce building panels for use in the modular construction of warehouses, low cost permanent housing, hotels, and other buildings. Finally there is a significant need for a precast foundation wall system that can be positioned on a prepared soil or gravel surface and operably interconnected to a poured concrete floor without utilizing onsite forms or other expensive building techniques.

SUMMARY OF THE INVENTION

It is one aspect of the present invention to provide a composite wall panel that has superior strength, high insulating properties, is lightweight for transportation and stacking purposes and is cost effective to manufacture. Thus, in one embodiment of the present invention, a substantially planar insulative core with interior and exterior surfaces is positioned between concrete panels that are reinforced with carbon fiber grids positioned substantially adjacent to the insulative core. In a preferred embodiment of the present invention, the interior layer of concrete is comprised of a low-density concrete. Furthermore, as used herein, insulative core may comprise any type of material that is thermally efficient and has a low heat transfer coefficient. These materials may include, but are not limited to, Styrofoam®-type materials such as expanded polystyrenes, extruded polystyrenes, extruded polypropylene, polyisocyanurate, combinations thereof and other materials, including wood materials, rubbers, and other materials well known in the construction industry.

It is yet another aspect of the present invention to provide a superior strength composite wall panel that utilizes carbon fiber materials that are oriented in a novel geometric configuration that interconnect the insulative core to both the interior and exterior concrete panels. In one embodiment of the present invention, a plurality of carbon fibers are oriented in a substantially diagonal orientation through the insulative core and which may be operably interconnected to carbon fiber mesh grids positioned proximate to the interior and exterior surfaces of the insulative core and which operably interconnect both the interior and exterior concrete panels to the insulative core. Preferably, the carbon fiber mesh grid is comprised of a plurality of first carbon fiber strands extending in a first direction that are operably interconnected to a plurality of second carbon fiber strands oriented in a second direction. Preferably, the carbon fiber mesh grids are embedded within the interior and exterior concrete panels.

It is a further aspect of the present invention to provide a lightweight, composite concrete foundation wall panel that is adapted to be selectively interconnected to a structural steel frame. Thus, in one embodiment of the present invention attachment hardware is selectively positioned within the foundation wall panel during fabrication that is used to quickly and efficiently interconnect the panel to a structural frame.

It is another aspect of the present invention to provide a low density concrete foundation wall panel that has sufficient compressive strength to allow a second building panel to be stacked in a vertical relationship, on which can support a vertical load in the form of a floor truss or other structural member. Alternately, it is another related aspect of the present invention to provide a composite lightweight foundation wall panel that can be utilized in a corner adjacent to a second foundation wall panel, or aligned horizontally with a plurality of foundation wall panels in a side by side relationship.

It is a further aspect of the present invention to provide a composite foundation wall panel with at least a portion with insulative material that has superior compressive strength than typical composite materials comprised of Styrofoam® and other similar materials. Thus, in another aspect of the present invention, a plurality of structural metallic reinforcing members are placed throughout the insulative core and which extend substantially between an upper end and lower end of the insulative core. Preferably, these reinforcing members are comprised of steel carbon-fiber or other materials.

It is still yet another aspect of the present invention to provide a composite foundation wall panel that can be easily modified to accept any number of interior textures, surfaces or cladding materials for use in a plurality of applications. Thus, the present invention is capable of being finished with a stucco, siding, drywall other type of interior surface.

It is yet another aspect of the present invention to provide a composite modular foundation wall panel that can be used to quickly and efficiently construct modular buildings and temporary shelters and is designed to be completely functional with regard to electrical wiring and other utilities such as telephone lines, etc. Thus, the present invention in one embodiment includes at least one utility line which is positioned at least partially within the composite wall panel and which accepts substantially any type of utility line which may be required in residential or commercial construction, and which can be quickly interconnected to exterior service lines. This utility line may be oriented in one or more directions and is generally positioned near the interior surface of the foundation wall panel.

It is yet another aspect of the present invention to provide a novel configuration of the insulative core that assures a preferred spacing between the insulative core and the reinforcing ribs. More specifically, the spacing is designed to provide a gap between the insulative core panels to assure that concrete carbon fiber stirrups and metallic reinforcing bars are properly positioned between the insulative core panels. This improved and consistent spacing enhances the strength and durability of the foundation panel when interconnected to the facing material, carbon fiber grids and transverse fibers and/or steel pre-stressing strands.

It is still yet another aspect of the present invention to provide an insulated concrete foundation panel that is comprised of a exterior face wall with a plurality of reinforcing ribs emanating therefrom. The space between the ribs receives foam insulation, thereby increasing the insulative properties of the foundation wall and reducing the overall density of the foundation wall. The exterior face in one embodiment of the invention is additionally strengthened with at least one carbon fiber grid that generally extends horizontally therethrough. During fabrication, the carbon fiber band is preferably tensioned between about 500-3000 lbs. so that once released the carbon fiber band will retract somewhat, thus placing the hardening concrete in a compressed state. The foundation wall panel may also include a footer positioned adjacent to a top edge and a bearing pad positioned at a bottom edge. The footer provides a location for the placement of main building walls and the bearing pad is designed to increase the footprint of the wall panel on a soil or pea stone, and which subsequently becomes operably interconnected to the concrete floor surface.

It is still yet another aspect of the present invention to provide an insulative foundation panel that is quickly manufactured and durable. More specifically, one embodiment of the present invention is manufactured in an exterior face up configuration. As used herein, "face up" configuration refers to the exterior surface of the foundation wall panel being in an uppermost portion of the casting form during fabrication. This configuration allows for the efficient placement of the insulative foam panels, reinforcing strands and carbon fiber grid material. Since the foundation wall is substantially comprised of a concrete base material, the finished product is fire resistant, substantially maintenance free, mold resistant, insect proof, wind resistant and projectile resistant. In addition, the use of insulation in-between the ribs provides a foundation wall panel that is insulated, in one embodiment having an R factor of about 20 or more. Further, with proper treatment of the concrete, the foundation wall panel is substantially water resistant.

Thus, in one embodiment of the present invention, an insulative wall panel is provided, comprising:

a concrete exterior face wall having an upper edge, a lower edge, and lateral edges therebetween, said face wall having at least one carbon fiber strip extending between said lateral edges;

a plurality of ribs extending from said concrete exterior face wall between said upper edge and said lower edge, said plurality of ribs reinforced with a reinforcing rod and interconnected to said concrete exterior face wall with a carbon fiber material; and a plurality of insulation panels placed adjacent to said plurality of ribs, thereby providing a lightweight, strong and highly insulative foundation wall panel.

It is another aspect of the present invention to provide a composite wall panel which can be easily modified to accept any number of exterior textures, surfaces or cladding materials for use in a plurality of applications. Thus, the present invention is capable of being finished with a brick surface, stucco, siding and any other type of exterior surface. In one embodiment of the present invention, a paraffin protective covering is provided on the exterior surface for protection of the exterior surface during manufacturing. The paraffin additionally prevents an excessive bond between the individual bricks and exterior concrete wall to allow the removal of a cracked or damaged brick and additionally has been found to reduce cracking in the bricks due to the differential shrinkage of the exterior concrete layer and clay brick. Furthermore, other types of materials such as drywall and other interior finishes can be applied to the interior concrete panel as necessary for any given application.

Thus, in one embodiment of the present invention the insulative core may have an interior and/or an exterior surface which is undulating, i.e., wavy alternative embodiments may have channels or protruding rails, spacer "buttons", a "waffleboard" configuration, or other shapes which create a preferred spacing between the surface of the insulative material and the fiber grids. Preferably, the spacing apparatus, channels, rails or other spacers are integrally molded with the insulative core to reduce labor and expenses. Alternatively, these spacing apparatus may be interconnected to the insulative foam after manufacturing, and may be attached with adhesives, screws, nails, staples or other interconnection means well known by one skilled in the art.

Thus, in one embodiment of the present invention, a low density, substantially planar carbon reinforced concrete building panel is provided, and which comprises: a foam core having an inner surface, an outer surface, an upper end, a lower end, and a plurality of perimeter edges, said foam core comprising at least one cut-out portion extending substantially between at least two of said plurality of perimeter edges; a first concrete material positioned adjacent said outer surface of said foam core; a first carbon fiber material positioned within said first concrete material; a second carbon fiber material positioned within said at least one cut-out portion of said foam core and extending through said foam core beyond said outer surface and in operable contact with said first carbon fiber material; at least one first reinforcing bar positioned proximate to said at least one carbon fiber material within said cut-out portion, and extending substantially between said upper end and said lower end of said foam core; and a second concrete material positioned within said cut-out portion of said foam core, and extending substantially from said upper end to a lower end of said foam core.

It is a further aspect of the present invention to provide a lightweight, durable building panel which utilizes concrete and expanded polystyrene materials, along with a unique geometry of carbon fiber, steel reinforcing rods, and wire mesh to create a building panel with superior strength and durability. The building may utilize one or more reinforcing materials such as carbon fiber, wire mesh or steel reinforcing bars positioned along 1) a perimeter edge; 2) an interior portion within the perimeter edge; or 3) both along the perimeter edges and within a predetermined interior portion of the building panel. Thus, in another embodiment of the present invention a lightweight, durable concrete building panel is provided, comprising: a substantially planar concrete panel comprising an inner surface, an outer surface, an upper end and a lower end, and a substantially longitudinal axis defined between said upper end and said lower end; a first carbon fiber grid positioned within said substantially planar concrete panel between said upper end and said lower end and positioned proximate to said inner surface; a foam core having an inner surface and an outer surface positioned within said substantially planar concrete panel and extending substantially between said upper end and said lower ends of said substantially planar concrete panel; at least one carbon fiber shear strip extending through said foam and oriented in a substantially linear direction between said upper end and said lower ends of said substantially planar concrete panel; at least one first reinforcing bar positioned proximate to said at least one carbon fiber shear strip, and extending substantially between said upper end and said lower end of said substantially planar concrete panel; and a wire mesh material positioned above said upper surface of said foam core and proximate to said outer surface of said substantially planar concrete panel.

In a preferred embodiment of the present invention, the insulative core is comprised of a plurality of individual insulative panels. The seam of the insulative panels preferably has a cut-out portion which is used to support reinforcing materials such as rebar, carbon fiber or other material.

It is a further aspect of the present invention to provide a method of fabricating an insulative concrete building panel in a controlled manufacturing facility which is cost effective, utilizes commonly known building materials and produces a superior product. It is a further aspect of the present invention to provide a manufacturing process which can be custom tailored to produce a building panel with custom sizes, allows modifications for windows and doors, and which utilizes a variety of commonly known materials without significantly altering the fabrication protocol.

Thus, in one aspect of the present invention, a method for fabricating a lightweight, durable concrete building panel is provided, comprising:

a) providing a form having an upper end, a lower end, and lateral edges extending therebetween;

b) positioning a first concrete material into a lower portion of said form;

c) positioning a first grid of carbon fiber material into said first layer of concrete material;

d) positioning a foam core onto said first layer of concrete material, said layer of foam core having a plurality of cut-out reinforced sections, said reinforced sections comprising a second grid of carbon fiber material extending into said first layer of concrete material and a reinforcing bar extending substantially along an entire length of said reinforced section and positioned proximate to said second grid of carbon fiber material.

e) positioning a second layer of concrete within said plurality of reinforced sections; and f) removing said lightweight, concrete building panel from said form.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
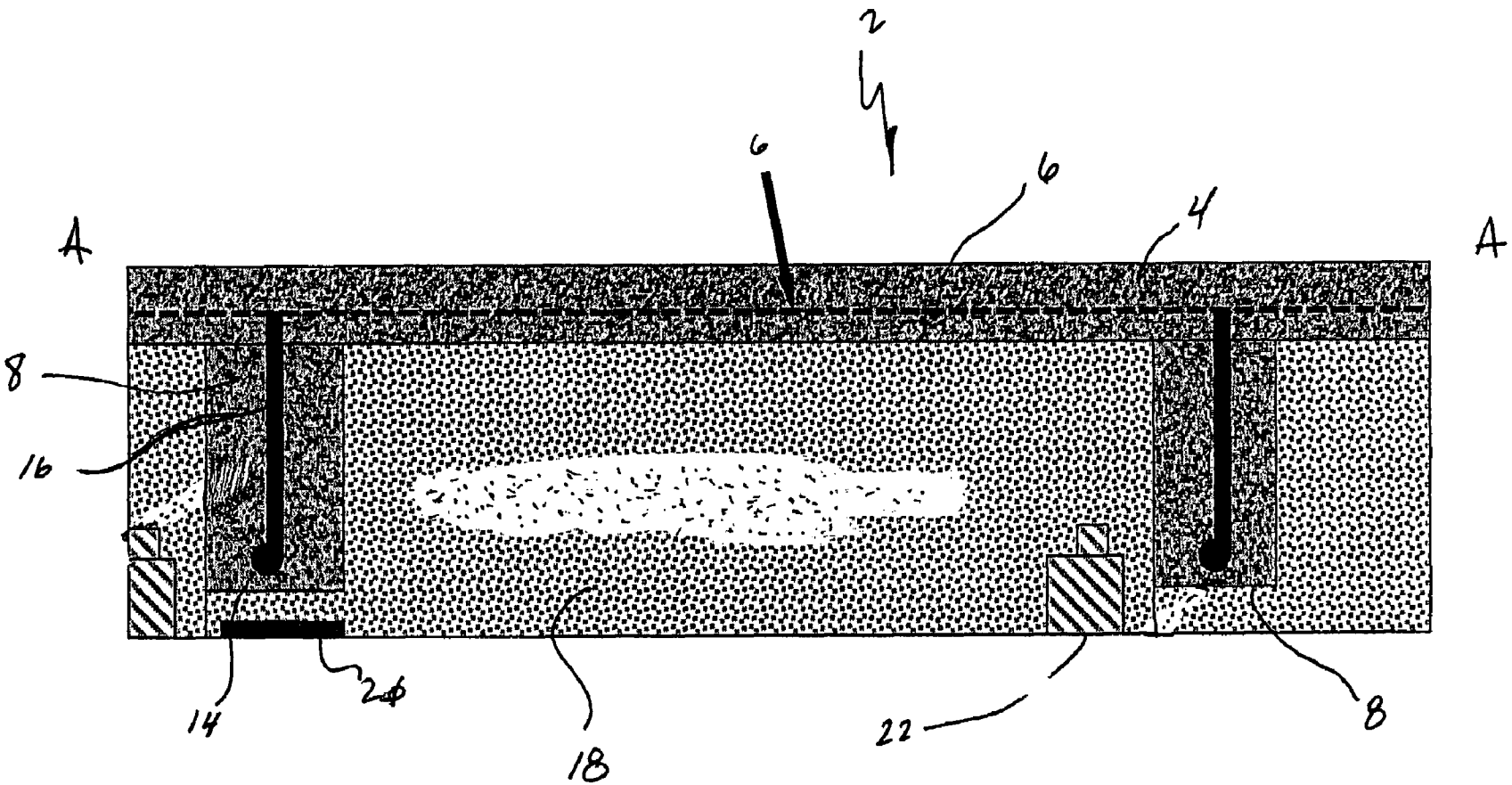
FIG. 1 is a top sectional plan view of an insulated foundation panel of one embodiment of the present invention.

To assist in the understanding of the present invention the following list of components and associated numbering found in the drawings is provided herein:

| # | Component |
|---|---|
| 2 | Foundation panel |
| 4 | Exterior face wall |
| 6 | Carbon fiber strip |
| 8 | Reinforcing rib |
| 10 | Upper edge |
| 12 | Lower edge |
| 14 | Reinforcing bar |
| 16 | Carbon fiber stirrups |
| 18 | Foam insulation |
| 20 | Wood strip |
| 22 | Channel |
| 24 | Footer |
| 26 | Bearing pad |
| 28 | Foundation material |
| 30 | Lip |
| 32 | Concrete floor |
| 34 | Utility conduit |
| 36 | Outlet |
| 38 | Bolt |
| 40 | Foam plug |
| 42 | End column |
| 46 | Composite building panel |
| 48 | Insulative core |
| 50 | Interior carbon fiber grid |
| 52 | Exterior carbon fiber grid |
| 54 | Carbon fiber strands |
| 56 | Thermal/vapor barrier |

-continued

| # | Component |
|---|---|
| 58 | Interior concrete layer |
| 60 | Exterior concrete layer |
| 62 | Utility conduit |
| 64 | Exterior cladding |
| 66 | Pre-stressed cable |
| 68 | Reinforcing bar |
| 70 | Wire mesh |
| 72 | Lifting anchor |
| 74 | Reinforced window/door frame |
| 76 | Lifting anchor reinforcing mesh material |
| 78 | Insulative core cut-out |
| 80 | Insulative core inner surface |
| 82 | Insulative core outer surface |
| 84 | Insulative core upper end |
| 86 | Insulative core lower end |
| 88 | Weep tube |
| 90 | Building panel upper end |
| 92 | Building panel lower end |
| 94 | Fabrication form |
| 96 | Panel thickness |
| 98 | Foam rope |
| 100 | Caulking |
| 102 | Expansion joint |
| 104 | Steel structural column |
| 106 | Bearing angle with gussets |
| 108 | Slotted lateral connector hardware |
| 110 | Mineral wool board |
| 112 | Concrete floor slab |
| 114 | Unistrut channel with posts |
| 116 | Column clip |
| 118 | Threaded fastener |
| 120 | Compressible gasket/seal |
| 122 | Pilaster |
| 124 | Interconnection stud |
| 126 | Thermal Break |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
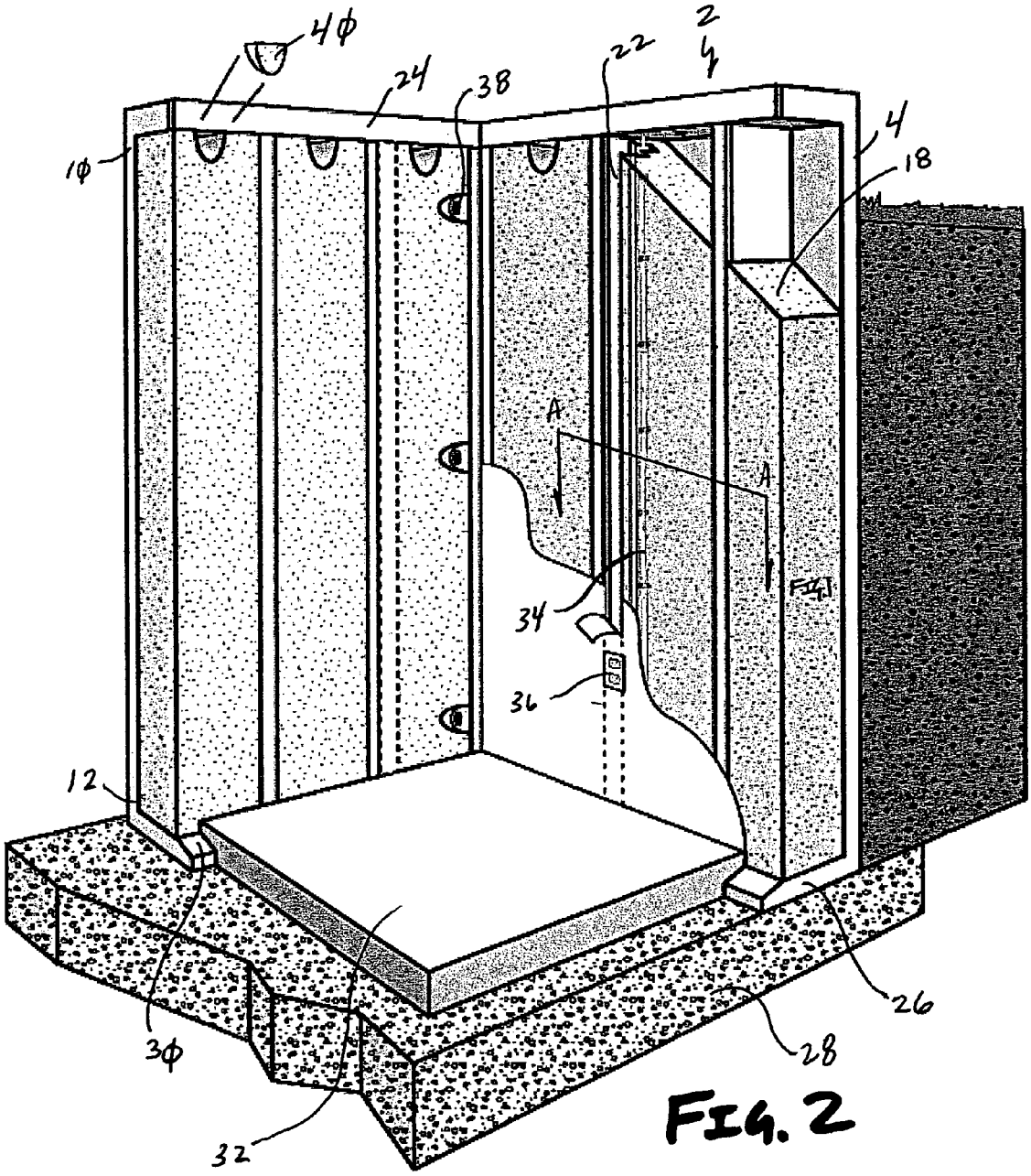
FIG. 2 is a perspective view of interconnected insulated foundation panels positioned on a pea stone base.

Referring now to FIGS. 1-3, one embodiment of an insulated foundation wall panel 2 is shown. More specifically, an insulated foundation panel 2 is provided that includes an exterior face wall 4 with one or more embedded carbon fiber strips 6. Interconnected to the exterior face wall 4 are a plurality of reinforcing ribs 8 running generally from an upper edge 10 to a lower edge 12 of the foundation panel 2. Tying the ribs 8 to the foundation wall 2 are reinforcing bars 14 and carbon fiber or metallic stirrups 16. Preferably, the space between each rib 8 is filled with foam insulation 18, thus providing a foundation panel 2 that is strong, light, and that has superior insulative properties. Optionally, some embodiments of the present invention employ wood, foam or metal strips 20 running substantially the length of the ribs 8 to provide a location for nails, screws, etc. such that sheet rock or other wall finishings may be applied to the foundation panel 2.

Referring again to FIG. 1, an insulative foundation panel 2 is provided that includes the face wall 4 having a plurality of ribs 8 emanating therefrom. The space between each rib 8 is filled with foam insulation 18, preferably 8" thick EPS regrind foam. The foam insulation 18 may also include channels 22 running its length that provide locations for the placement of utility conduits for electrical wiring, water pipe, etc.

The ribs 8 of one embodiment of the present invention run substantially the height of the insulative foundation panel 2 and are approximately three inches thick. The ribs 8 preferably are tied into the face wall 4 with metal or carbon fiber stirrups 16 that are located adjacent to the upper edge and the lower edge of the insulated face wall 2 and, which provide shear loading capability. However, one skilled in the art will appreciate that the face wall and ribs may be placed in one continued operation. In addition, steel reinforcing bars 14 vertically reside in each rib 8 adjacent to the front surface thereof to add additional strength and stiffness.

The face wall 4 of one embodiment of the present invention is two inches thick and may range in height from about 5 feet to about 9 feet, thus providing an insulative foundation panel for crawl spaces and/or full basements, respectively. In addition, the insulative foundation panel 2 may include a plurality of eight inch wide carbon fiber strips 6 that lie horizontally within the face wall 4 about 36 inches above the lower edge. The carbon fiber strip 6 may also be tensioned when the concrete of the insulated foundation panel 2 is placed, thus yielding a wall panel that is pre-stressed compressively after set. One example of a carbon fiber grid material which may be used in the present invention is the "Mec-Grid™" carbon fiber material manufactured by Hexcel Clark-Schwebel and as described in U.S. Pat. No. 6,236,692, which is incorporated herein in its entirety by reference. Here, also shown is an optional wood screw strip 20 that runs substantially the length of each rib 8. The wood screw strip 8 is generally spaced the same distance as each rib, in one embodiment 24 inches apart, and provides a location for the introduction of nails or other fastening devices to interconnect finishing materials, such as sheet rock, onto the insulated foundation panel 2. One skilled in the art will appreciate that the robustness of the manufacturing process allows the spacing of the ribs 8 and the optional wood screw strips 20 to be varied depending on the desires of the manufacturer, and including alternative materials.

Referring now to FIG. 2, a pair of interconnected foundation panels are shown. Here, the facewall 4 is shown with a footer 24 interconnected adjacent to the upper edge 10 and a bearing pad 26 located at its lower edge 12. The footer 24 is adapted to receive other walls, wall panels, bricks, stones, etc. The bearing pad 26 is provided to increase the foot print of the foundation panel 3 upon the building foundation, such a bed of tamped material 28. Preferably, in one embodiment of the invention, six inches of ⅜" pea stone is used that provides a foundation for the bearing pad 26. The bearing pad 26 also may include a lip 30 that interfaces with a concrete floor 32 that will bear down on the lip 36 of the bearing pad 26 to help stabilize the finished assembly. In addition, utility channels 22 are provided wherein portions of the insulation 18 have been removed to provide a location for conduits 34 and electrical outlets 36. One skilled in the art will appreciate that once the conduits 34 and other utilities installed, the insulation 18 may be used to fill the channel 22 to increase the insulative properties of the wall.

Adjacent foundation panels 2 are generally interconnected in one embodiment with bolts 38. In order to provide a location for the bolts 38, the insulation 18 must be cut away to reveal apertures integrated into the wall panel 2. Once the bolts 38 or other fasteners are in place, a foam plug 40 may be added to the insulation panel 18 to increase the insulative properties of the foundation panel 2.

Figure 3A:
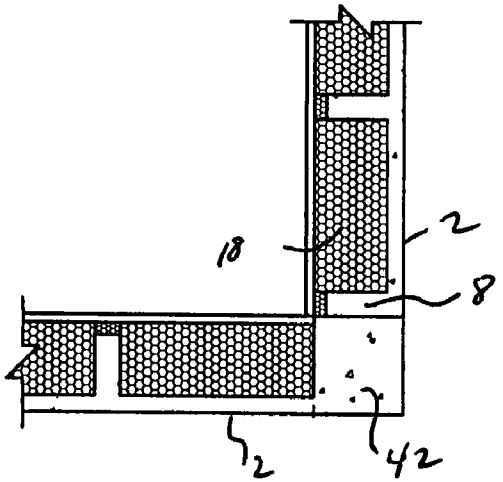
FIG. 3 are top plan views of various configurations of interconnected walls.
Figure 3B:
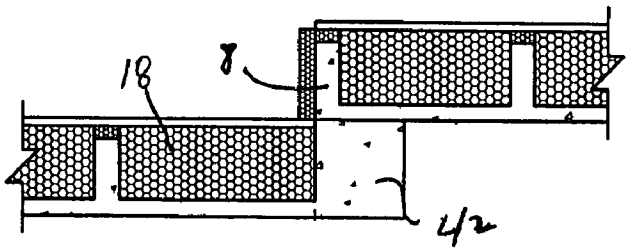
Figure 3C:
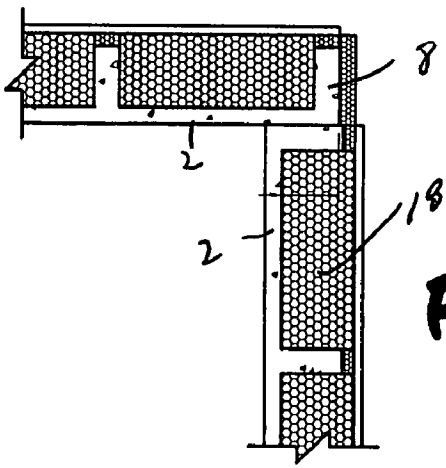

Referring now to FIG. 3, views are shown of adjacent foundation wall panels 2 in a variety of configurations. For example, with specific reference to FIG. 3A, adjacent foundation wall panels 2 are shown interconnected wherein the bolts are driven through the rib 8 of one wall panel 2 into an end column 42 of an adjacent wall panel 2. Alternatively, bolts may be used to interconnect the face wall 4 of the wall panel 2 into the end column 42 of an adjacent foundation panel 2, as shown in FIG. 3B. Further, as shown in FIG. 3C, bolts may be used to interconnect the rib 8 of one wall panel 2 into the face wall 4 of another wall panel 2. One skilled in the art will appreciate that many different wall panel arrangements and assemblies may be utilized without departing from the scope of the invention. In addition, after the adjacent wall panels 2 are in place, additional insulation, such as two inch foam strips may be field installed to ensure that substantially all concrete faces of the finished wall are covered, thus increasing the insulative property of the system as a whole.

Referring again to FIG. 1, one method of constructing the insulative foundation panel 2 is shown and described. Embodiments of the present invention are constructed "face up", which is believed novel. Initially, the insulation panels 18 are placed in the casting form, wherein the reinforcing ribs 8 defined by the spaces between the insulative panels 18. Reinforcing bars 14 and carbon fiber stirrups are then positioned within the space for the reinforcing ribs 8. Concrete is then poured into the space. One or more carbon fiber strips 6 are placed at a predetermined location within the exterior face wall 4. One skilled in the art will appreciate that additional steps, such as vibration, may be employed to ensure that the consistency of the concrete is per specification, and to improve the density of the concrete. Finally, wood, foam, or metal screw strips 20 may be applied along the edges of the ribs 8. One skilled in the art will also appreciate that lifting devices may also be formed into the wall panel 2 to aid in the transportation or lifting thereof. Although not shown, the insulative foundation panel 2 will include a footer and a bearing pad that is placed when the ribs 8 are formed, and which may be tied into the face wall 4 with reinforcing bar 14 and stirrups as well. The footer is subsequently covered at least partially with concrete when the concrete floor is poured during installation at the building site, thus providing additional structural support.

With regard to the concrete utilized in various embodiments of the present application, the face wall and associated ribs may be comprised of a low density concrete such as Cret-o-Lite™, which is manufactured by Advanced Materials Company of Hamburg, N.Y. This is an air dried cellular concrete that is nailable, drillable, screwable, sawable and very fire resistant. In a preferred embodiment, the face wall is comprised of a dense concrete material to resist moisture penetration and in one embodiment is created using VISCO CRETE™ or equal product, which is a chemical that enables the high slumped short pot life liquification of concrete to enable the concrete to be placed in narrow wall cavities with minimum vibration and thus create a high density substantially impermeable concrete layer. VISCO-CRETE™ is manufactured by the Sika Corporation, located in Lyndhurst, N.J. The face wall is preferably about 2 inches thick. This concrete layer has a compression strength of approximately 5000 psi after 28 days of curing.

Positioned within the ribs is one or more reinforcing bars "rebar", which are generally manufactured from carbon steel or other similar metallic materials. Preferably, the reinforcing bar has a diameter of at least about 0.25 inches, and more preferably about 0.75-1.50 inches. As appreciated by one skilled in the art, the reinforcing bars 14 may be any variety of dimensions or lengths depending on the length and width of the wall panel 2, and the strength requirements necessary for any given project. As additionally seen in FIG. 1, the stirrups 16 that tie the ribs 8 into the face wall 4 are comprised of carbon fiber grid material, or alternatively metallic materials.

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

Figure 4:
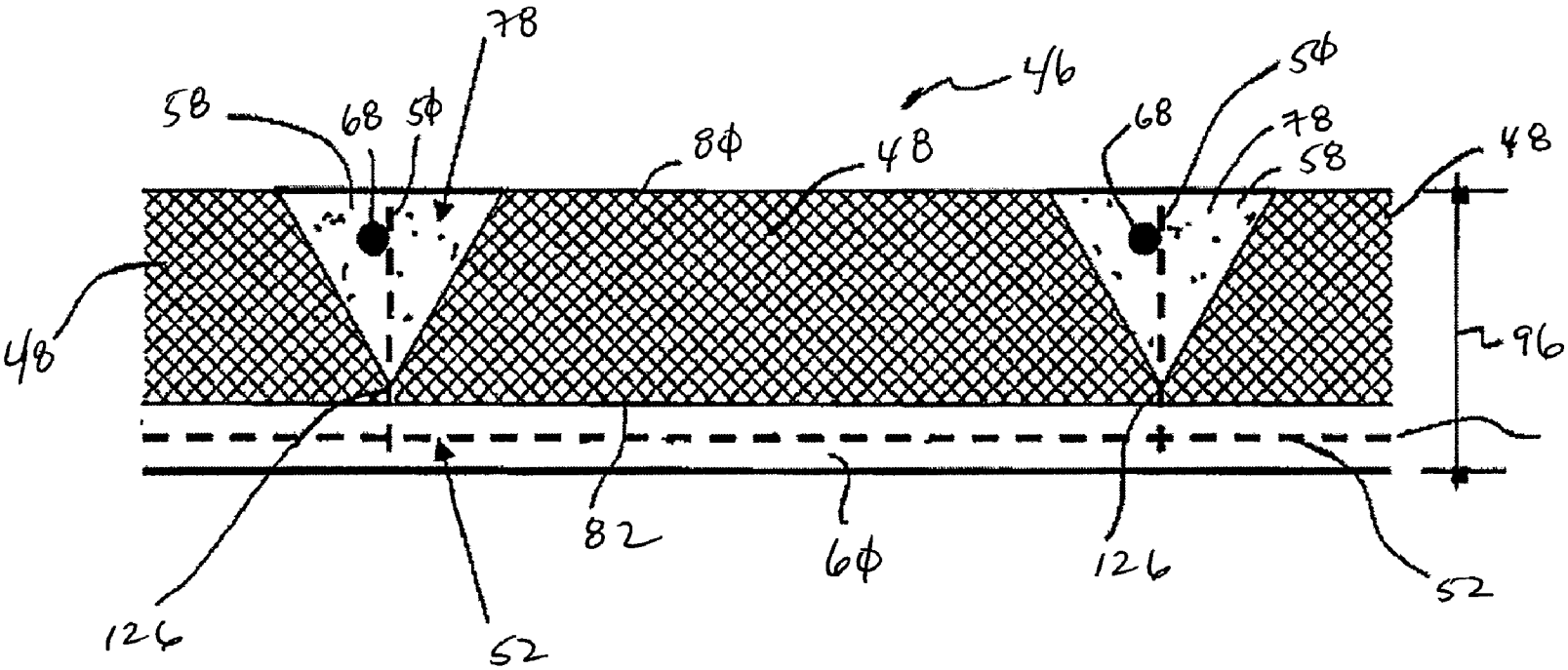
FIG. 4 is a cross-sectional top plan view of a composite building panel which represents one embodiment of the present invention.

Referring now to the drawings, FIG. 4 is a cross-sectional top plan view of one embodiment of the present invention which depicts a novel composite building panel 2. More specifically, the building panel 46 is generally comprised of an insulative core 4 which has an interior surface 80 and exterior surface 82 and a substantially longitudinal plane extending from a lower portion to an upper portion of said insulative core 4. Positioned within the insulated core 4 are one or more cut-outs 78 extending from the interior surface 80 and oriented toward an exterior surface 82. In a preferred embodiment, a thermal break 126 is provided at the apex of the cut-out and which has a dimension of at least about ½ inch and more preferably 1.0-2.0 inches and which separates the interior concrete layer 58 from the exterior concrete layer 60. The thermal break 126 provides a layer of insulation core 4, and hence improves the thermal efficiency and heat transfer characteristics of the building panel 2.

Positioned within each of the insulative core cutout portions 78 is an interior carbon fiber grid 50 which extends through the insulative core cutout 78 and is positioned adjacent to and more preferably operably connected to the exterior carbon fiber grid 52. The exterior carbon fiber grid 52 is further embedded within an exterior concrete layer 60, and which represents in one embodiment an exterior face of the composite building panel 2. As appreciated by one skilled in the art, the exterior concrete layer 60 may additionally include various types of exterior cladding 20 such as bricks, stucco, and other similar materials depending on the application. As further depicted in FIG. 4, the overall strength of the composite building panel 46 is increased by utilizing one or more reinforcing bars 24 within each of the insulative core cut-outs 78, or alternatively using prestressed cable 66. Although the total panel thickness is preferably between about 50 and 10 inches, depending on the application the panel thickness may vary between about 4 and 16 inches as appreciated by one skilled in the art.

Figure 5:
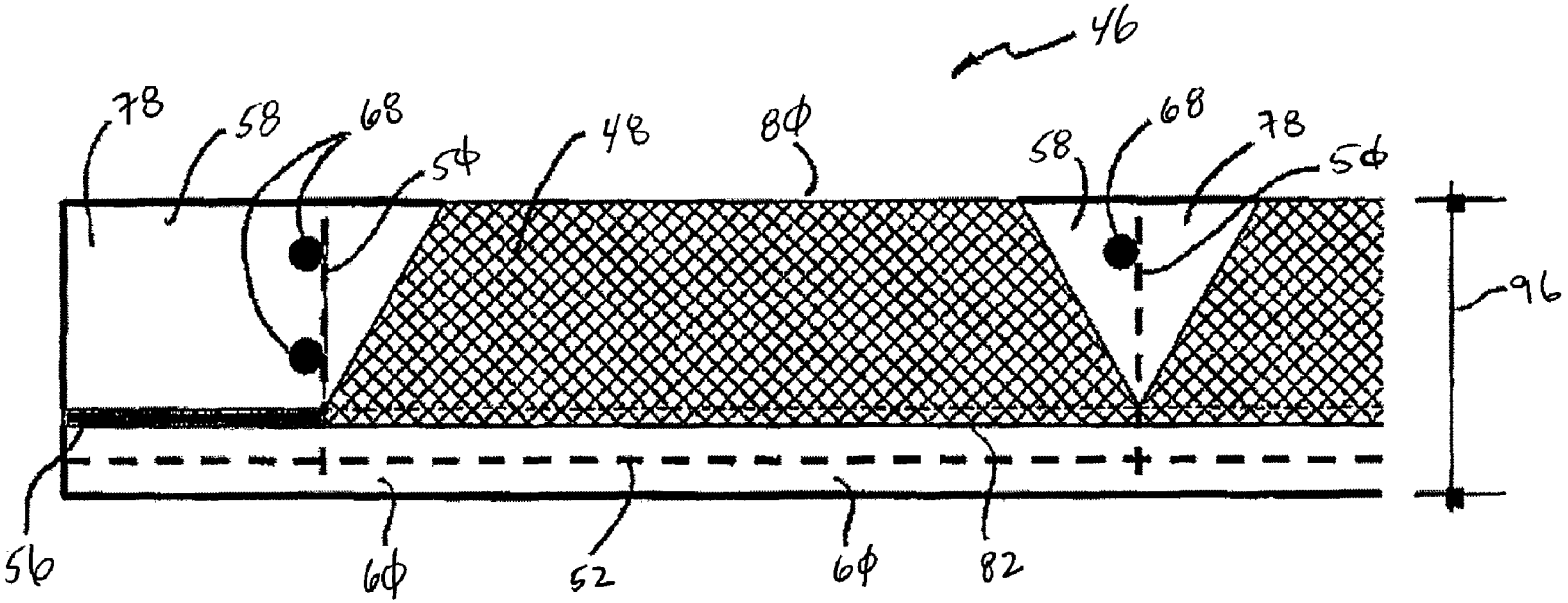
FIG. 5 is a cross-sectional top plan view of a composite building panel end section which represents one embodiment of the present invention.

Referring now to FIG. 5, a cross-sectional top plan view of a composite building panel end section is depicted herein. More specifically, the end section has components similar to the panel section shown in FIG. 7, but which has an additional insulative core cut-out portion 78 positioned near the panel end. The insulative core cut-out portion 78 further comprises a plurality of reinforcing bars 24 positioned adjacent an interior carbon fiber grid 6, and further includes an optional thermal/vapor barrier 56 which is utilized to increase the panel thermal efficiency, and thus prevent excessive heat loss. The thermal/vapor barrier 56 may be comprised of foam materials, polypropylenes, polyethylenes, rubbers, and other thermal/vapor barrier materials well known in the construction industry.

Figure 6:
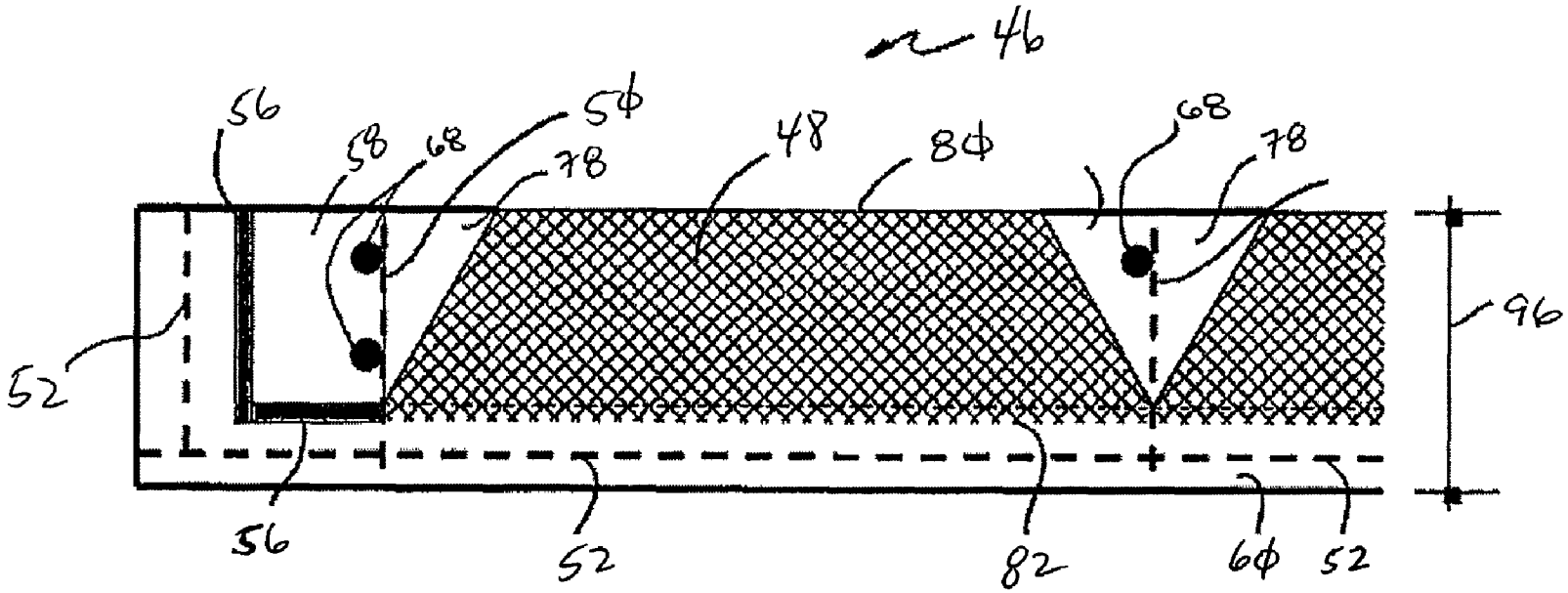
FIG. 6 is a cross-sectional top plan view of a composite building panel end return section which represents one embodiment of the present invention.

Referring now to FIG. 6, a cross-sectional top plan view of a composite building panel end return section is depicted herein. More specifically, the architectural panel end return section is designed for use on the end of a wall panel and includes an insulated cut-out portion 78 which further comprises additional thermal/vapor barrier materials 56 to further improve the heat transfer characteristics of the panel. Notwithstanding these differences, the remaining portion of the composite building panel 2 is similar to the embodiments shown in FIGS. 1 and 2, and includes an insulation core 48 with at least one interior carbon fiber grid 50 and an exterior carbon fiber grid 52, the exterior carbon fiber grid 52 being embedded in an exterior concrete layer 60.

Figure 7:
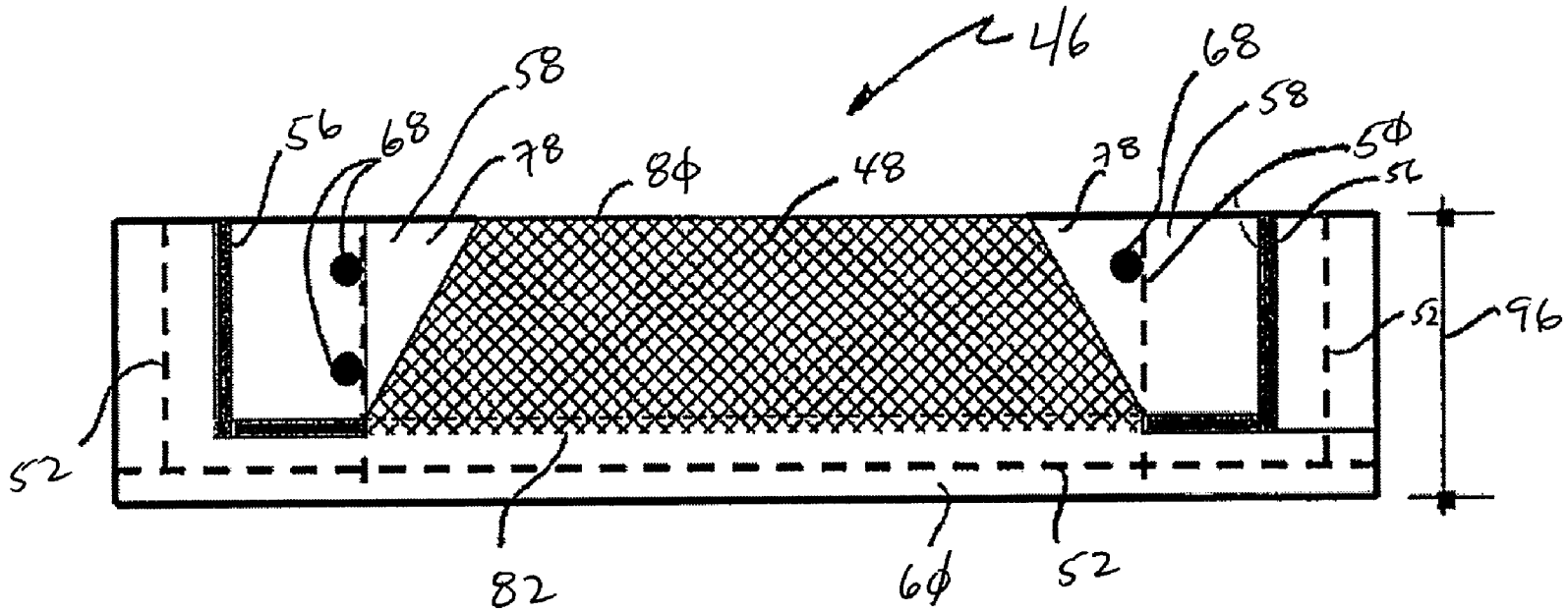
FIG. 7 is a cross-sectional top plan view of a composite building panel window return section, which represents one embodiment of the present invention.

Referring now to FIG. 7, a cross-sectional top plan view of a composite building panel window return section is provided herein. More specifically, the panel return section is used in applications adjacent to window and door openings, and which includes an interior insulative core 48 positioned between two insulative core cut-out portions 78 and having a total diameter of preferably about 6-8 inches. Each of the insulative core cut-out portions 78 are comprised of an interior carbon fiber grid 6, one or more reinforcing bars 24, and thermal/vapor barriers 56 positioned within the insulative core cutout 78 and covered with an interior concrete layer 58. The exterior face of the composite building panel 2 further comprises an exterior carbon fiber grid 52 which is embedded within the exterior concrete layer 60.

Figure 8:
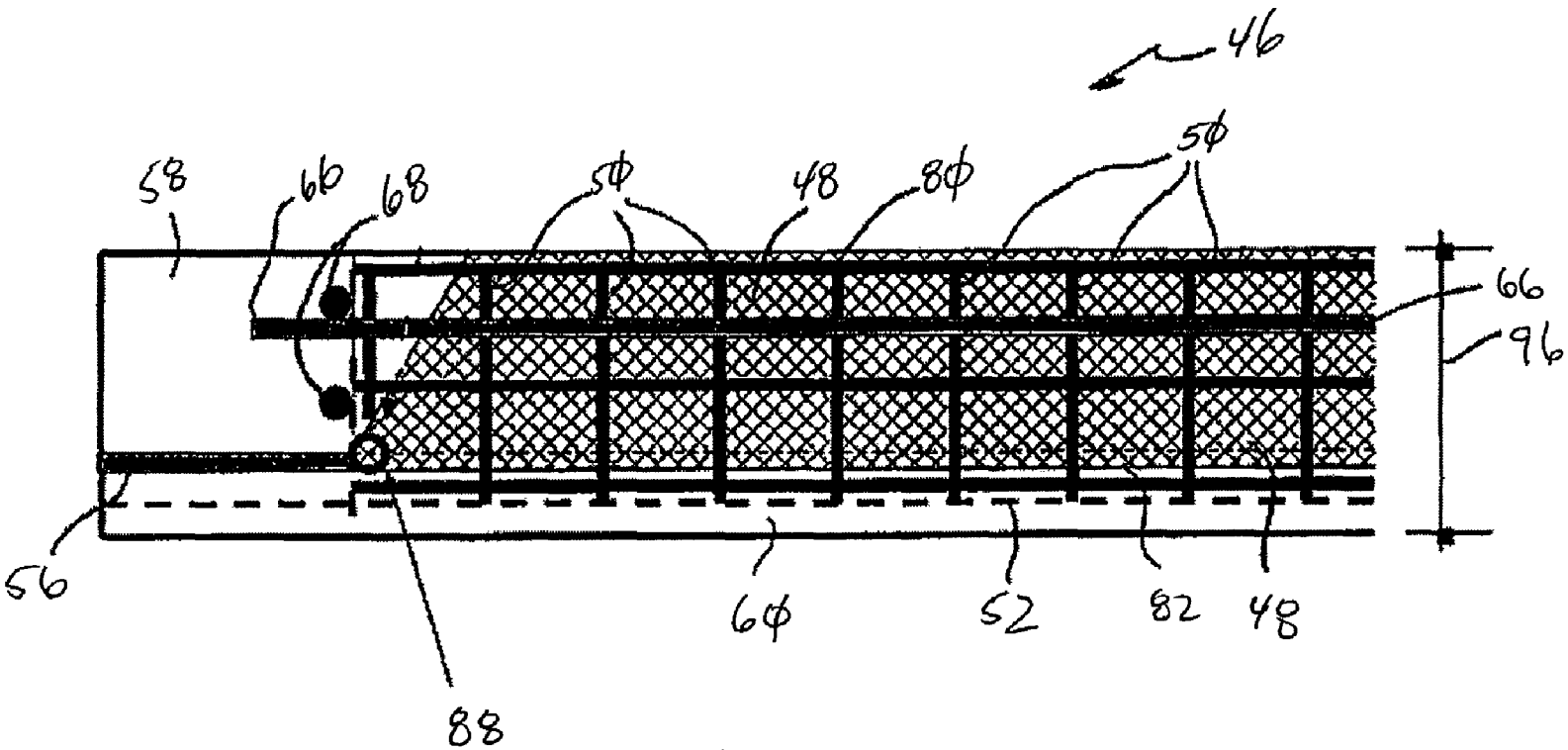
FIG. 8 is a cross-sectional top plan view of a composite building panel bottom section, which represents one embodiment of the present invention.

Referring now to FIG. 8, a cross-sectional top plan view of a composite building panel bottom section is provided herein, and which further depicts an insulative core cut-out portion 78 which is used in conjunction with an interior concrete layer 58, and an interior carbon fiber grid 6. As further depicted in FIG. 8, both reinforcing bars 24 and prestress cable 66 are used to increase the structural integrity of the building panel bottom section. Furthermore, a weep tube 88 is provided to allow drainage of any moisture which may accumulate within the architectural panel bottom section. As further shown, a thermal/vapor barrier material 56 is also utilized to improve the thermal efficiency of the building panel 2.

Figure 9:
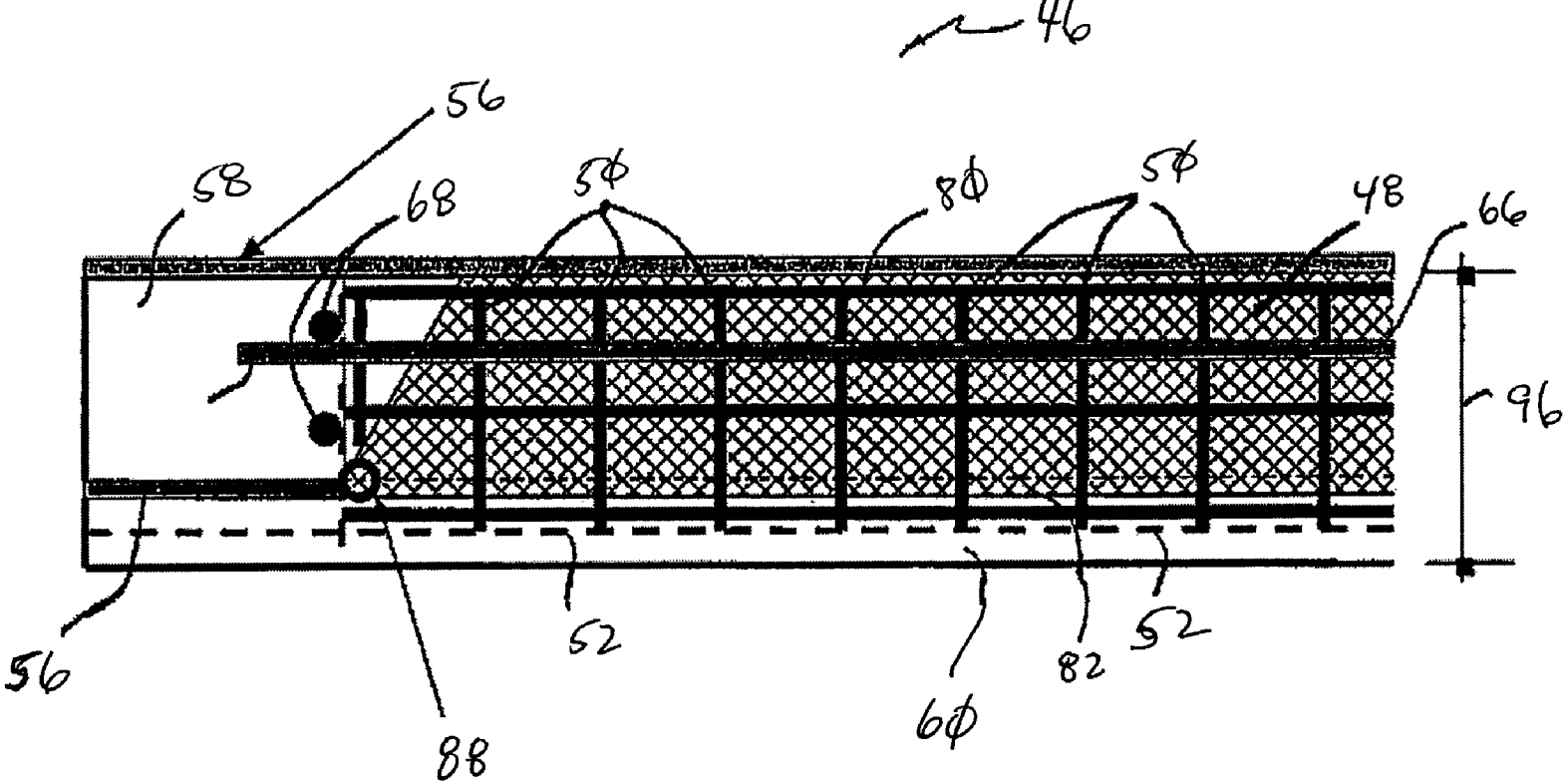
FIG. 9 is a cross-sectional top plan view of a composite building panel bottom section, which represents one embodiment of the present invention.

Referring now to FIG. 9, an alternative embodiment of the architectural panel bottom section shown in FIG. 8 is provided herein, and which generally comprises the same internal componentry with the exception of a thermal vapor barrier 56 positioned along the interior face of the architectural panel bottom section. The thermal/vapor barrier 56 as previously mentioned could be comprised of foams, plastic materials, concrete, wood, drywall or other commonly used materials which are well known in the construction industry.

Figure 10:
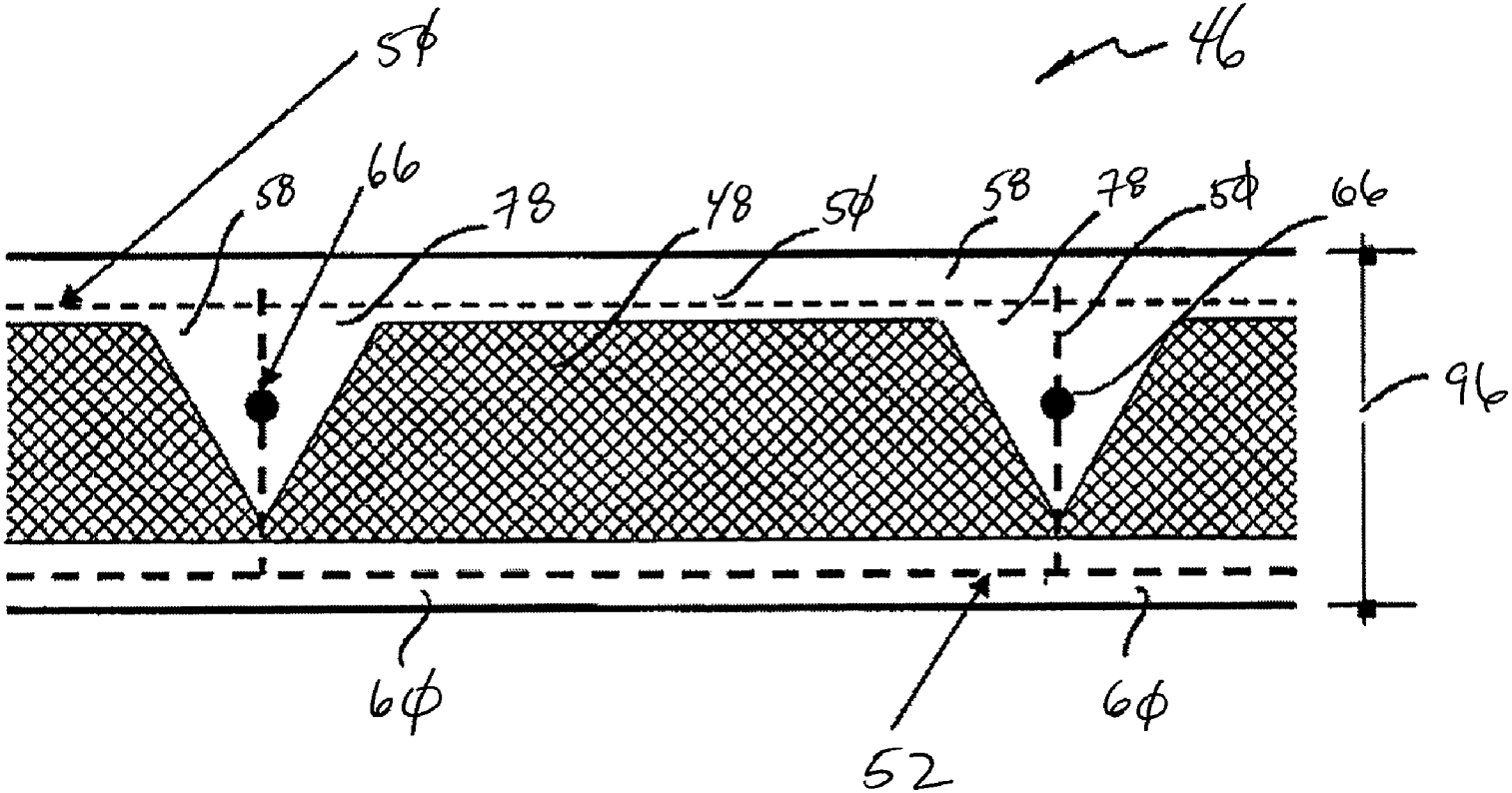
FIG. 10 is a cross-sectional top plan view of a composite building wall panel section, which represents one embodiment of the present invention.

Referring now to FIG. 10, an alternative embodiment of a wall panel section is provided herein, and more specifically comprises a wall panel composite building panel 2 which includes an additional layer of interior carbon fiber grids 6 positioned in close proximity to an interior surface, and within an interior concrete layer 58. As used herein, both the interior carbon fiber grid 6 and exterior carbon fiber grid 52 may be comprised of alternative materials such as wire mesh, fiberglass, and other construction materials to provide increased strength in structural integrity of the composite building panel. Preferably, however, the materials utilize a material known as MeC-GRID™ which is a carbon composite comprised of a plurality of individual carbon fibers held together with an adhesive or epoxy.

Figure 11:
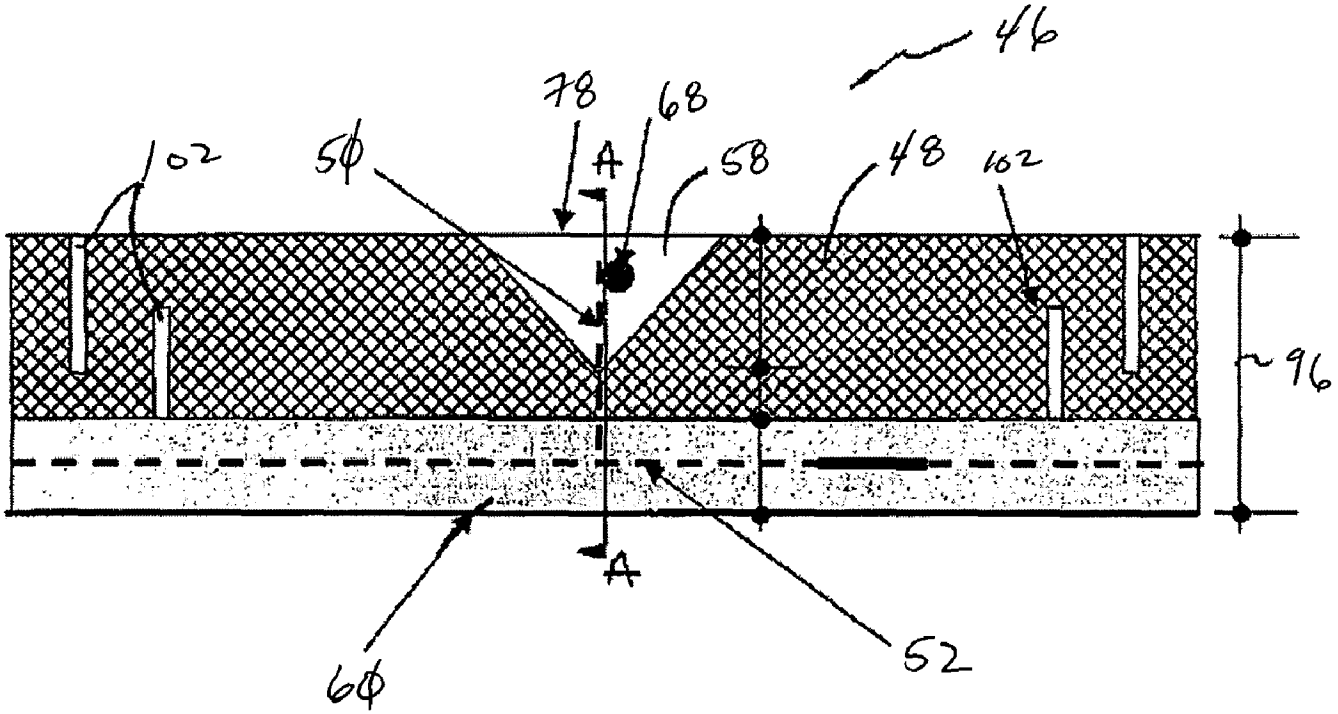
FIG. 11 is a cross-sectional top plan view of a composite architectural panel with a three-sided rib cut out portion and further including expansion joints.

Referring now to FIG. 11, a cross-sectional top plan view of a composite architectural building panel 2 of the present invention is provided herein, and which depicts a triangular shaped cut-out portion 78 which includes a interior carbon fiber grid 6, one or more reinforcing bars 24, and an interior concrete layer 58 positioned within the cut-out portion 78. Furthermore, a plurality of expansion joints 102 are provided within the insulative core 48 which are utilized to prevent excessive compression of the concrete building panel during manufacturing, transportation, and installation, and thus substantially eliminates hairline fractures of the concrete. The expansion joints are preferably cutout portions of the insulative core material 4, but other compressible materials may be positioned within the expansion joints 102 as appreciated by one skilled in the art.

Figure 12:
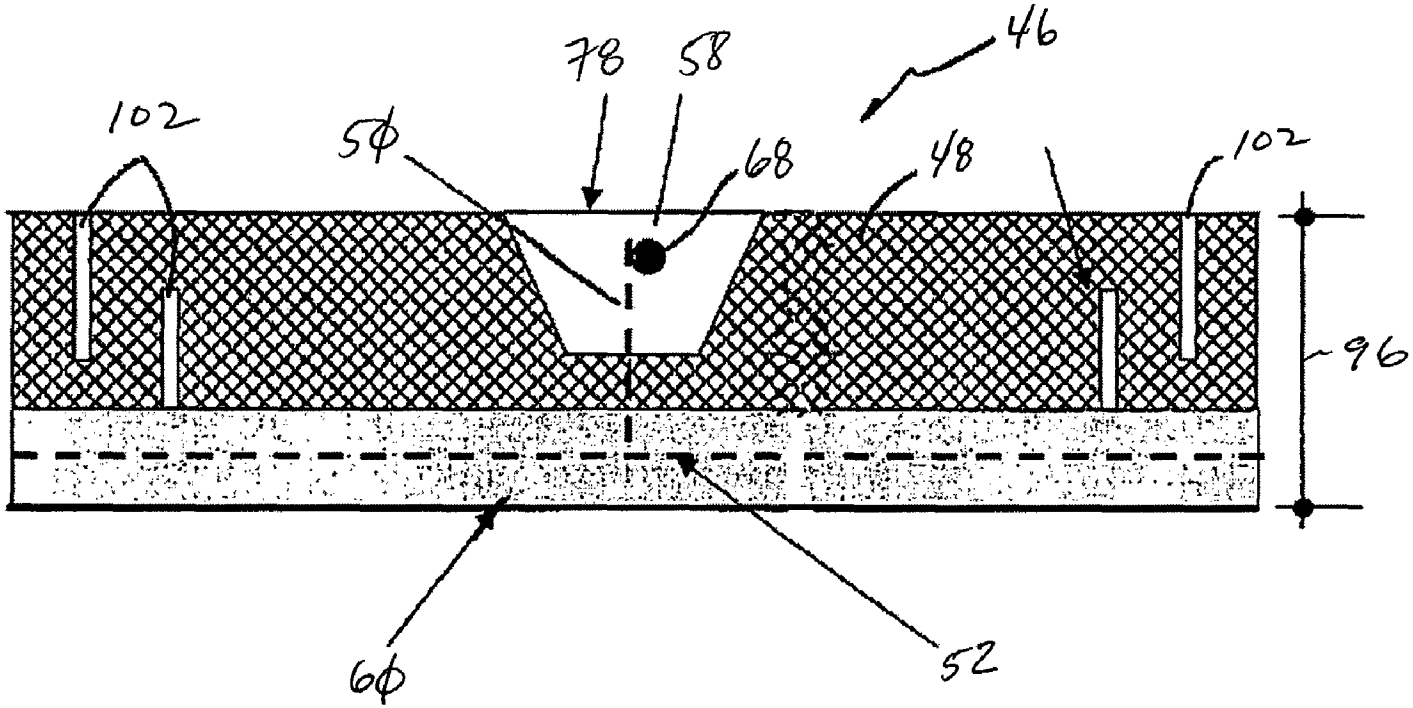
FIG. 12 is a cross-sectional top plan view of a composite architectural panel and including a four-sided mid rib cut out section.

Referring now to FIG. 12, a cross-sectional top plan view of an architectural panel with a four-sided mid rib is shown herein. More specifically, this embodiment is similar to the other architectural panels with the exception that the reinforcing rib cut-out portion 78 is four-sided as opposed to the triangular configurations shown in other embodiments. As appreciated by one skilled in the art, the cut-out portion 78 may have 9 cross-sectional geometric shapes which are triangular, rectangular, square, cylindrical, oblong or any other theoretical shape. As further depicted in FIG. 12, a plurality of expansion joints 102 are also utilized in this embodiment to help prevent cracking and the ultimate failure of the concrete materials.

Figure 13:
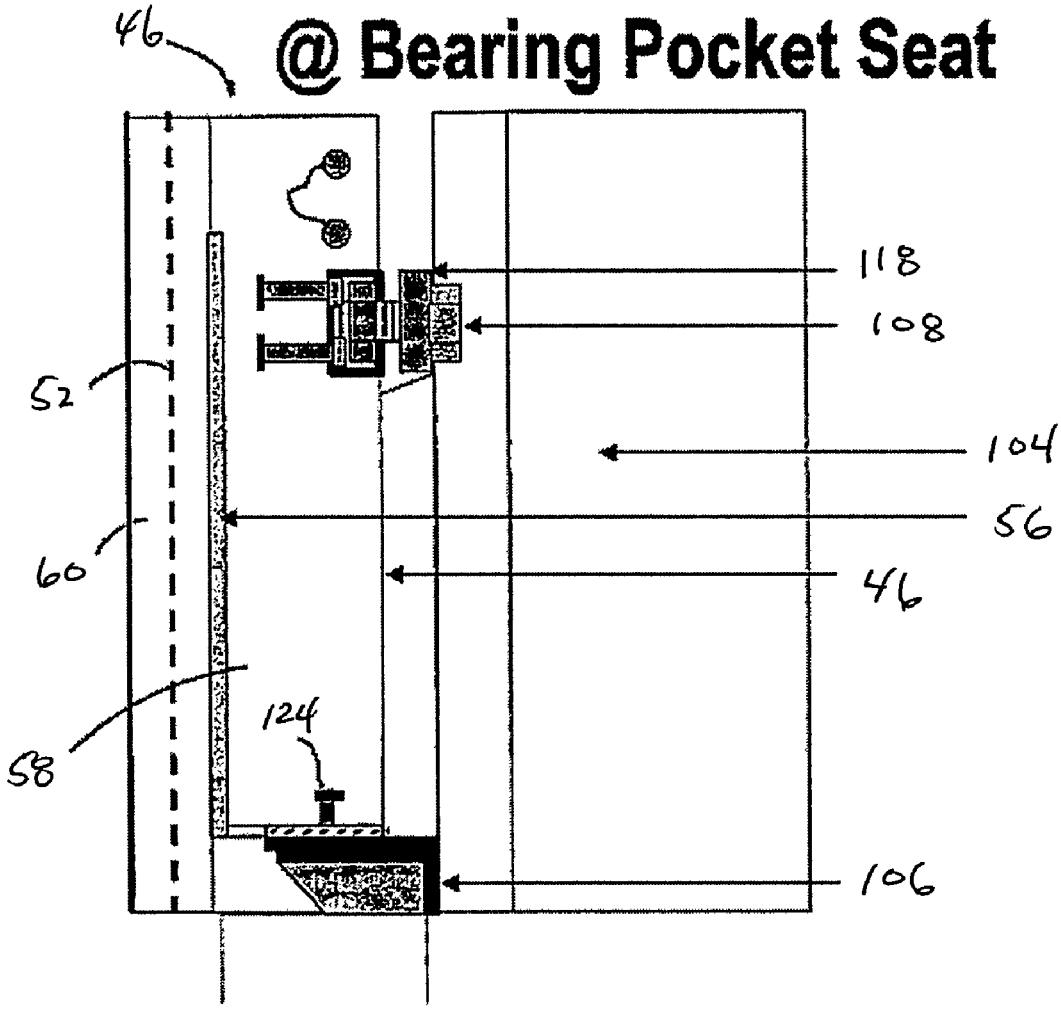
FIG. 13 is a cross-sectional front elevation view of an architectural building panel shown at a bearing pocket seat and operably interconnected to a steel girder.

Referring now to FIG. 13, an alternative embodiment of the present invention is provided herein and which depicts a cross-sectional front elevation view of a composite building panel 2 operably connected to a steel structural column 104. As provided herein, the composite building panel 2 further utilizes a thermal/vapor barrier 56, and is interconnected by the use of a slotted lateral connector hardware 108 configuration which has a plurality of bolts or other attachment hardware embedded in the interior concrete layer 58, and which is operably interconnected to the steel structural column 104. As further shown in FIG. 13, an interconnection stud 124 is embedded in the interior concrete layer 58 on a lower portion of the building panel 2, and which rests on a bearing angle with gussets 106 for vertical support. To provide horizontal adjustments between the structural column 104 and the composite building panel 2, a threaded fastener 118 may be rotated.

Figure 14:
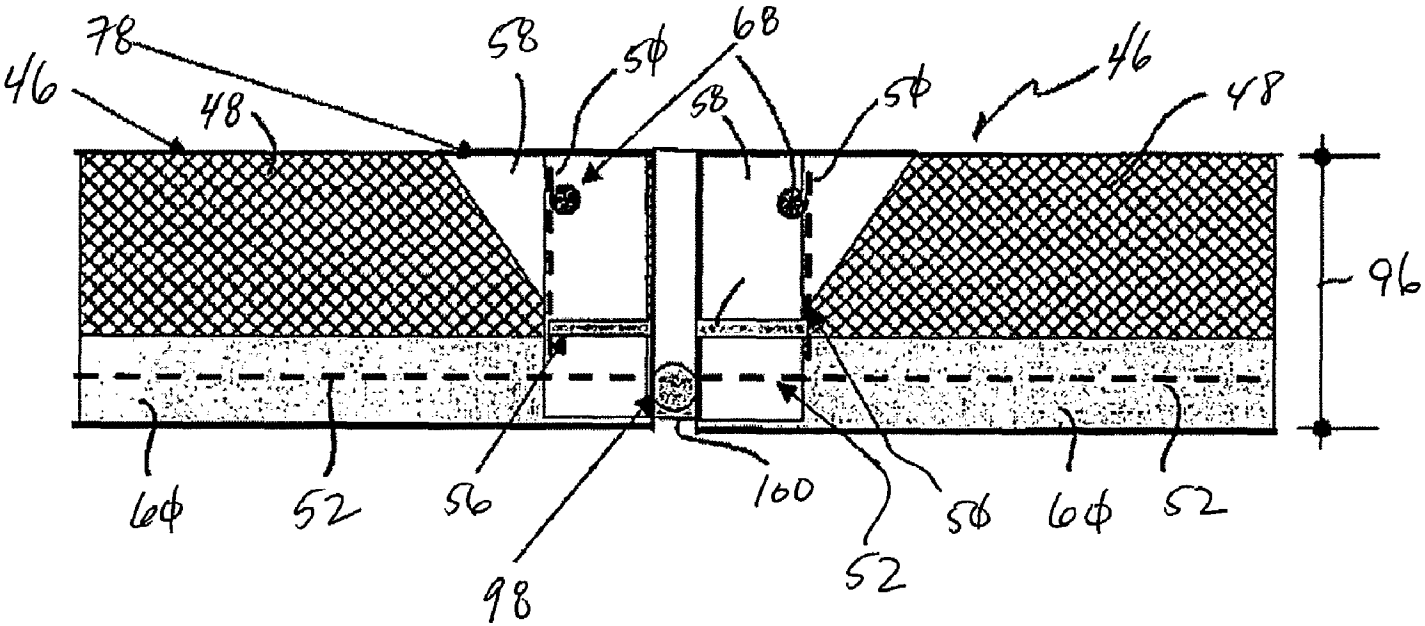
FIG. 14 is a cross-sectional top plan view of a first architectural building panel positioned adjacent a second architectural building panel, and further disclosing a thermally broken closed end rib joint.

Referring now to FIG. 14, a cross-sectional top plan view of two architectural panels positioned adjacent one another are provided herein, and which further include a thermally broken closed-end rib joint. More specifically, FIG. 14 depicts a first composite building panel 2 positioned adjacent a second composite building panel, and which includes a insulative core 48 with a insulative core cut-out portion 78 positioned substantially adjacent to one another. Each of the insulative core cut-out portions 78 may include one or more reinforcing bars 24, an interior carbon fiber grid 6, as well as a thermal vapor barrier 56. The exterior face comprises a exterior concrete layer 60 which includes an embedded exterior carbon figure grid 52. Positioned between the first composite building panel 2 and the second composite building panel is a foam rope 98 which is generally compressible and which impedes heat transfer between an interior and exterior structure of the composite building panels 2. Furthermore, a caulking material 100 may be positioned around the foam rope 98 to further improve the seal between the two building panels and improve the thermal efficiency.

Figure 15:
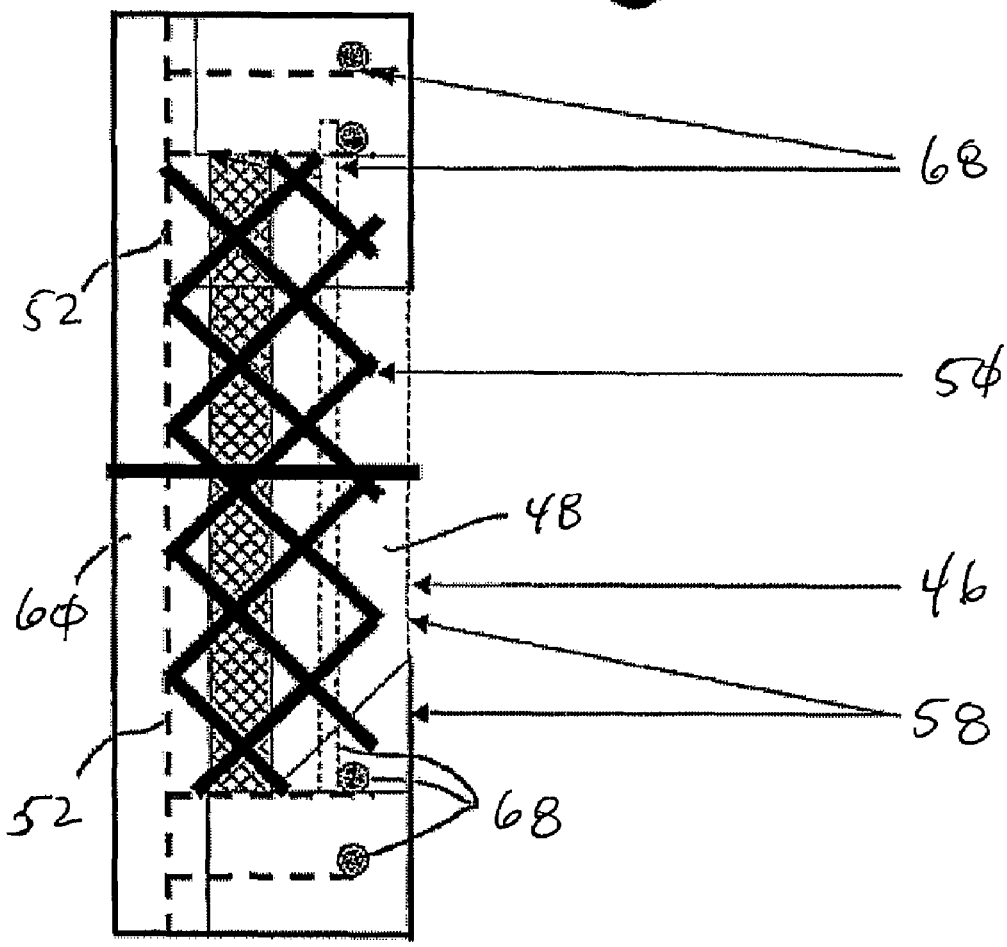
FIG. 15 is a cross-sectional elevation view taken at line AA of FIG. 12, and identifying the carbon fiber web material and other internal components of the architectural panel.

Referring now to FIG. 15, a cross-sectional front elevation view taken at line "AA" of FIG. 11 is provided herein. More specifically, the cross-sectional view identifies an architectural panel at the rib joint, and depicts the insulative core 4, the interior carbon fiber grid 6, the exterior carbon fiber grid 52, and the reinforcing bar 24 materials which are embedded within the composite building panel 2 for structural integrity. Furthermore, an interior concrete layer 58 may be positioned along an interior face of the composite building panel 2, or other materials such as wood, dry-wall, and other known construction materials.

Figure 16:
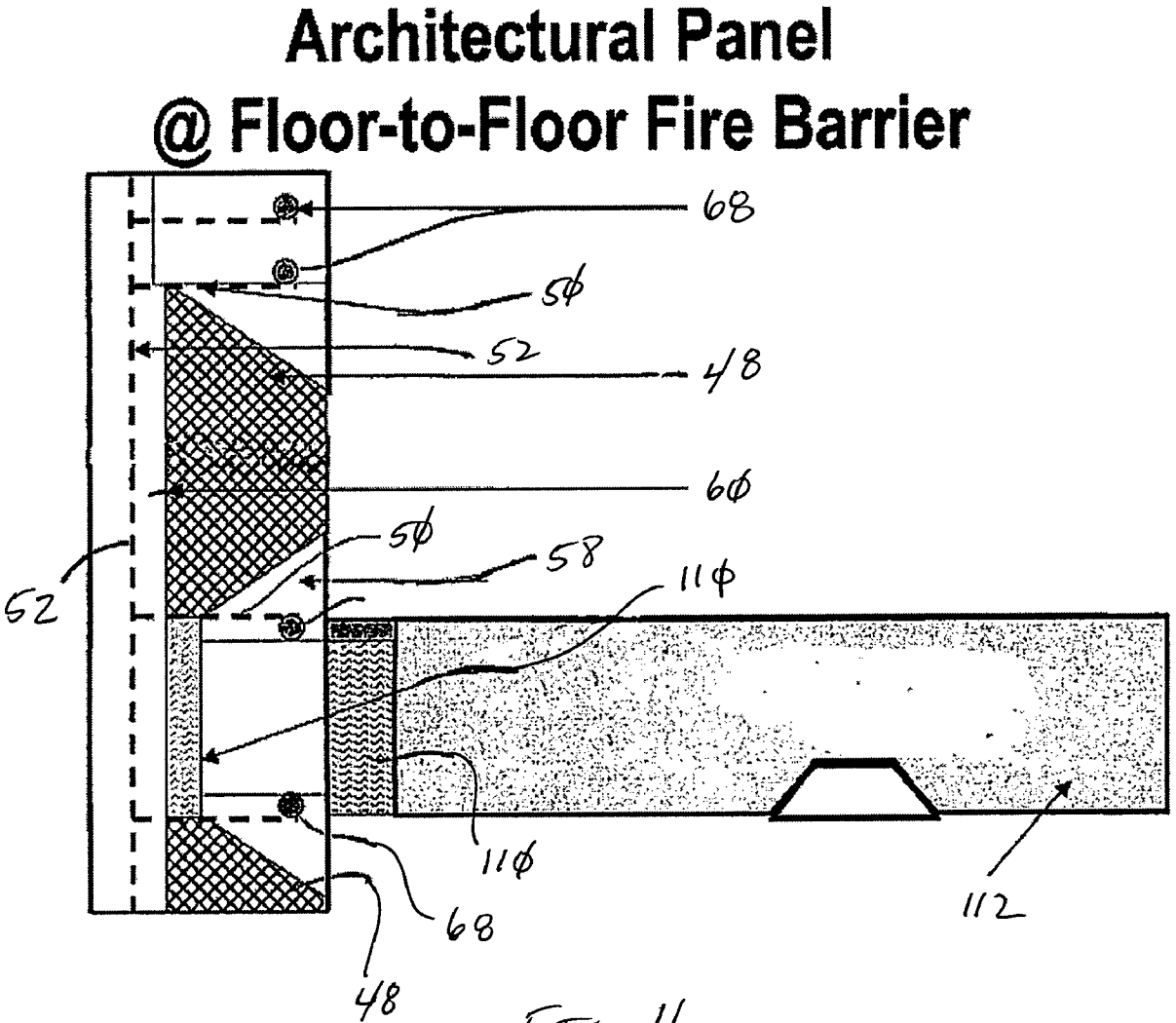
FIG. 16 is a cross-sectional front elevation view of an architectural composite building panel and depicting a floor to floor fire barrier positioned adjacent a horizontal floor section.

Referring now to FIG. 16, a cross-sectional front elevation view of an architectural composite building panel 2 which depicts a floor to floor fire barrier is provided herein. More specifically, a concrete floor slab 112 is positioned in a horizontal orientation and positioned adjacent to a vertical composite building panel 2 of the present invention. To provide a floor to floor fire barrier, a mineral wall board 110 may be provided in one or more locations in association with non interior concrete layer 58 to prevent the heat transfer between two adjacent floors in a building structure. As further depicted in FIG. 16, the insulative core cut-out 78 is shown within the insulative core 4, and further includes a plurality of interior carbon fiber grids 6, as well as an exterior carbon fiber grid 52 which is embedded in a exterior concrete layer 60. Furthermore, a plurality of reinforcing bars 24 may be provided as shown to provide additional structural integrity to the building panel 2.

Figure 17:
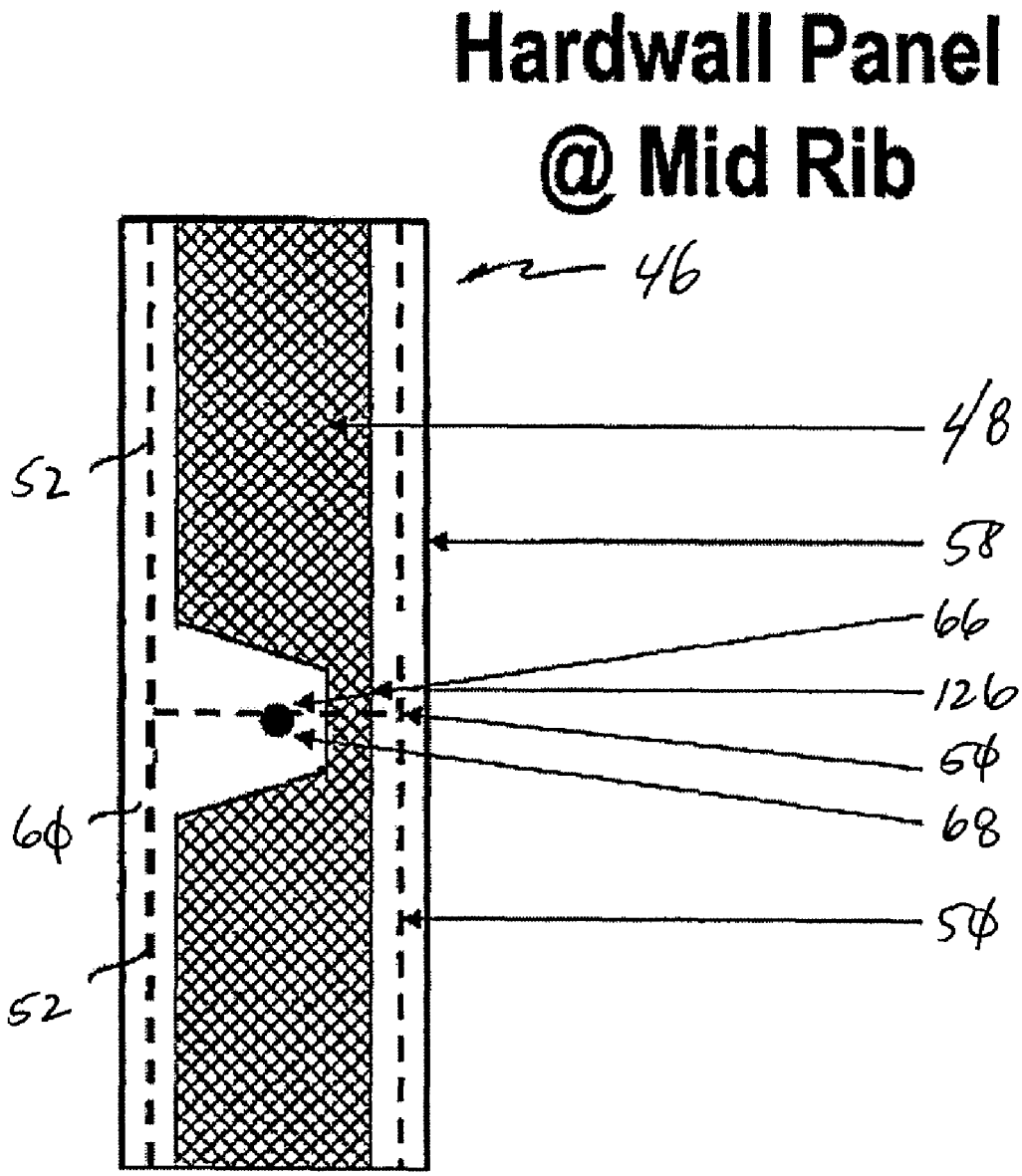
FIG. 17 is a cross-sectional front elevation view of a hardwall panel taken at amid rib section.

Referring now to FIG. 17, a cross-sectional front elevation view of a hardwall panel taken at a mid rib section is provided herein, and which generally depicts an insulative core 48 positioned between an exterior concrete layer 60, an interior concrete layer 58, and a interior carbon fiber grid 6 and exterior carbon fiber grid 52. The insulative core cut-out portion 78 further includes one or more reinforcing bars 24 or prestressed cables 66, and which also includes an interior carbon fiber grid 6 which extends substantially from the exterior concrete layer 60 to the interior concrete layer 58 for strength.

Figure 18:
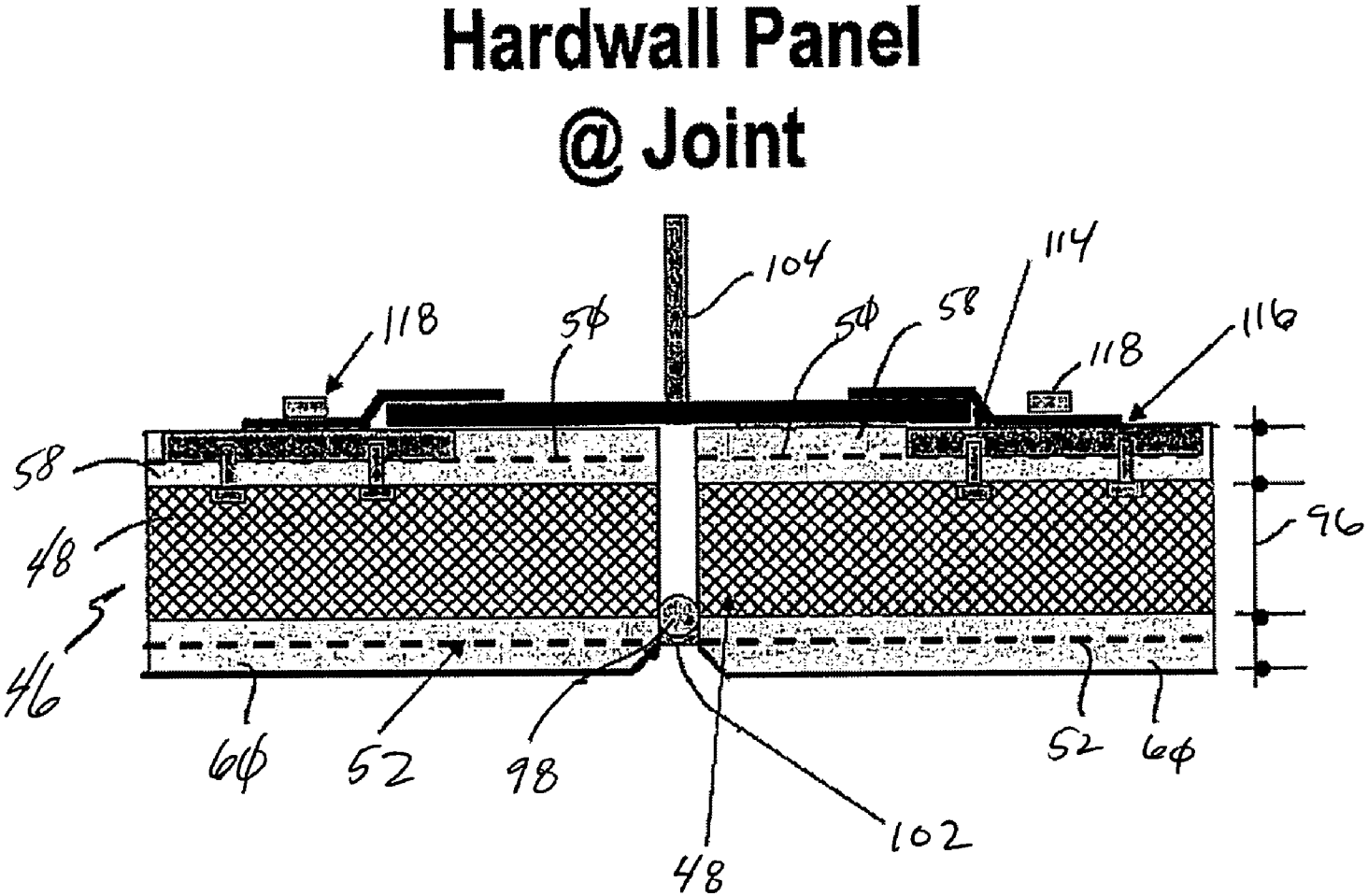
FIG. 18 is a cross-sectional top plan view of two adjoining composite building panels shown interconnected to a structural steel support member, and the associated hardware.

Referring now to FIG. 18, an alternative embodiment of the present invention is provided herein, and which depicts two composite building panels 2 operably interconnected to a steel structural column 104. More specifically, a unistrut channel with posts 114 is shown interconnected to an interior surface of each of the composite building panels 2, and are embedded into the insulative core 48 and into an interior concrete layer 58. These unistrut channels with parts 114 are further used in combination with a column clip 116 and threaded fasteners 118 to interconnect each of the composite building panels 2 to a steel structural column 104. By utilizing this type of attachment hardware, steel structural buildings may be quickly assembled utilizing the lightweight composite building panels of the present invention. As further depicted in FIG. 18, a foam rope 98 and caulking material 100 may be utilized for sealing and heat transfer purposes between each of the composite building panels 2.

Figure 19:
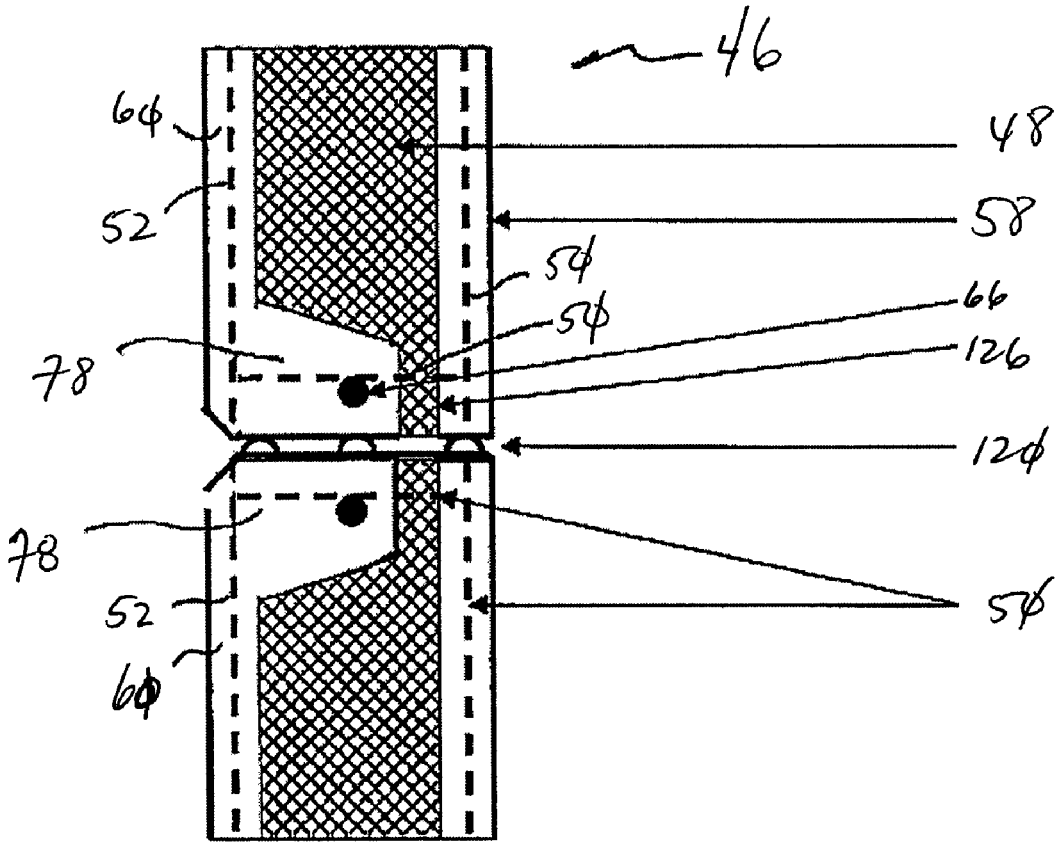
FIG. 19 is a cross-sectional front elevation view showing one composite building panel operably positioned above a second composite building panel.

Referring now to FIG. 19, a cross-sectional front elevation view showing one composite building panel operably positioned below a second composite building panel 2 is provided herein. More specifically, a compressible gasket seal 120 is positioned between the first composite building panel 2 and a second composite building panel positioned vertically on top of the first composite building panel 2. At the location where the composite building panels 2 are stacked, a insulative core cut-out portion 78 is provided, which includes one or more interior carbon fiber grid 6 which are interconnected to an exterior carbon fiber grid 52, and which are embedded in concrete along with either prestressed cable 66 or steel 5 reinforcing bars 68. By utilizing an insulative core 48 and interior and exterior carbon fiber grids, 50 and 52, respectively, it has been found that the composite building panels 2 of the present invention may be stacked vertically for lengths up to about 40 to 60 feet in an economical and safe manner.

Figure 20:
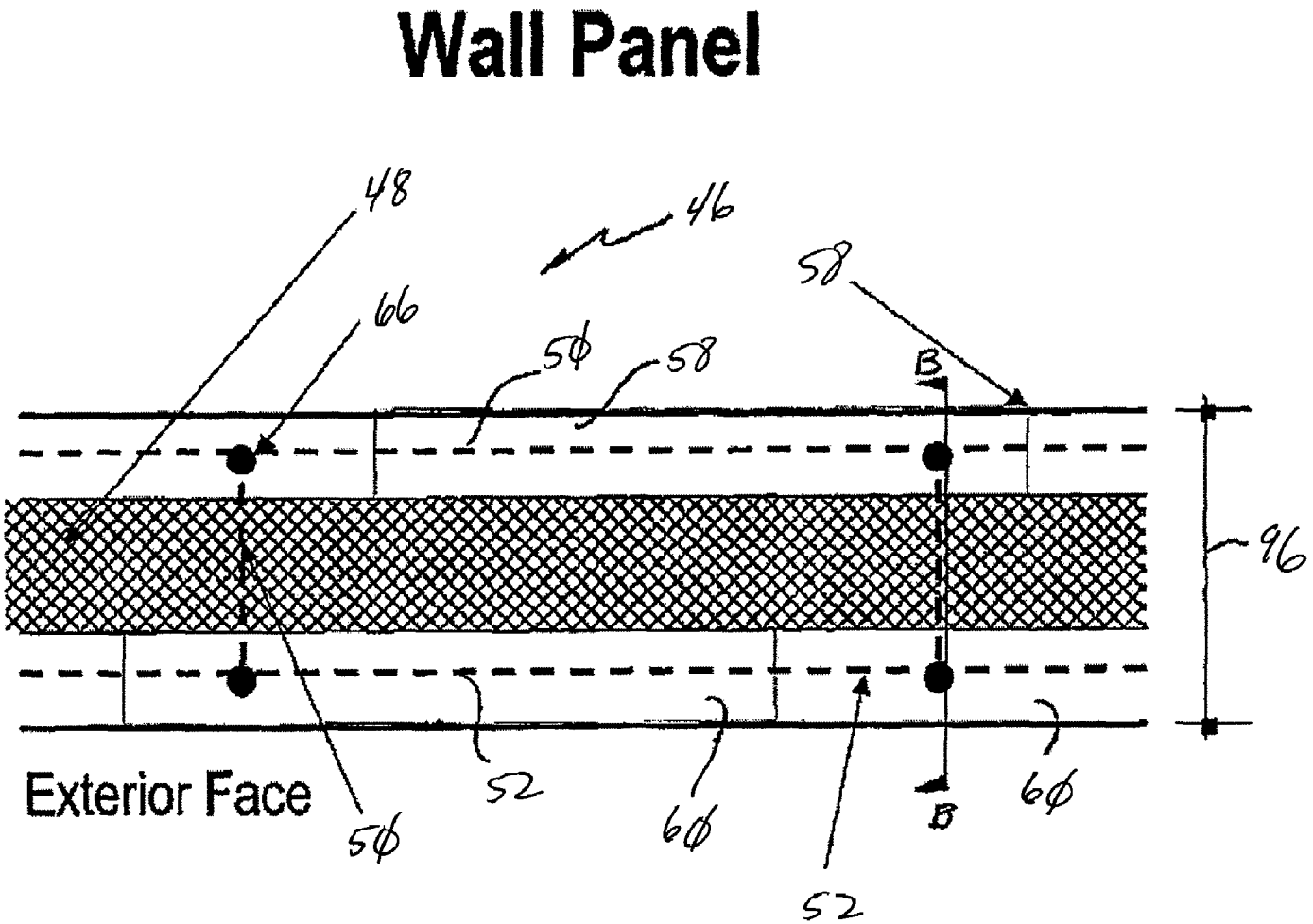
FIG. 20 is a cross-sectional top plan view of a composite building panel used in one embodiment to support a vertical load.

Referring now to FIG. 20, a cross-sectional top plan view of a composite building 54 wall panel 2 used in one embodiment to support a vertical load is provided herein. As shown in this embodiment, both the exterior carbon fiber grids 52 and interior carbon fiber grids 50 are positioned within a exterior concrete layer 60 and into concrete layer 58, respectively, and which are interconnected with either prestressed cable 66 and another layer of interior carbon fiber grid 50 material. By providing the additional structural integrity with the interior and exterior carbon fiber grids, it has been found that the wall panels may be used to vertically support other panel walls, or can be load bearing to support trusses and other structural frame work.

Figure 21:
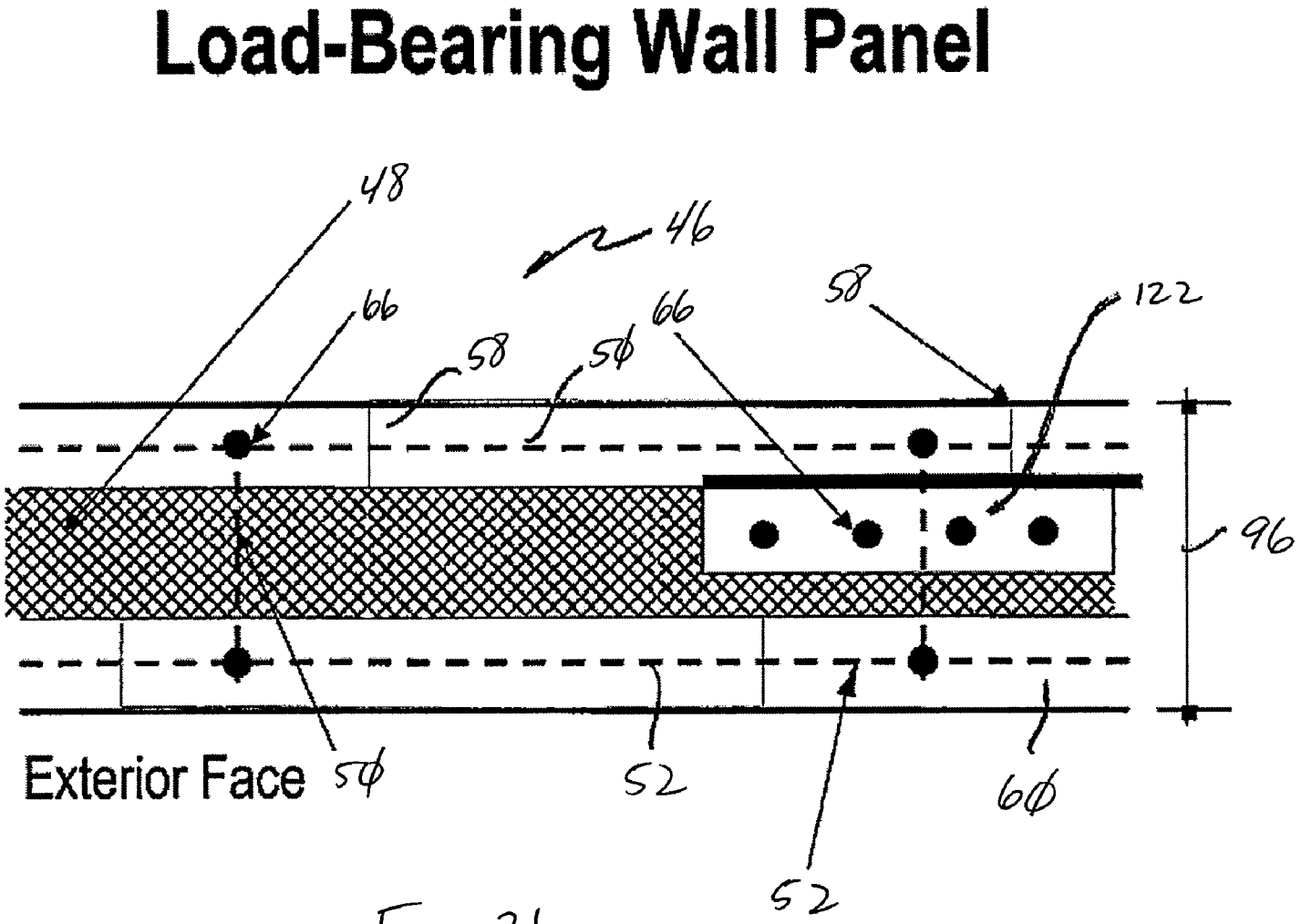
FIG. 21 is a cross-sectional top plan view of a load bearing composite wall building panel with a reinforced pilaster portion.

Referring now to FIG. 21, a cross-sectional top plan view of a load bearing composite wall building panel 56 with a reinforced "pilaster" portion 122 is provided herein. More specifically, the insulative core cut-out portion 78 comprises a plurality of prestressed cable 66, or alternatively reinforcing bars 68, and are used in combination with an interior carbon fiber grid 50 and interior concrete layers 58 to provide a reinforced load bearing panel wall which is capable of compressive structural loads of at least about 3500 psi.

Figure 22:
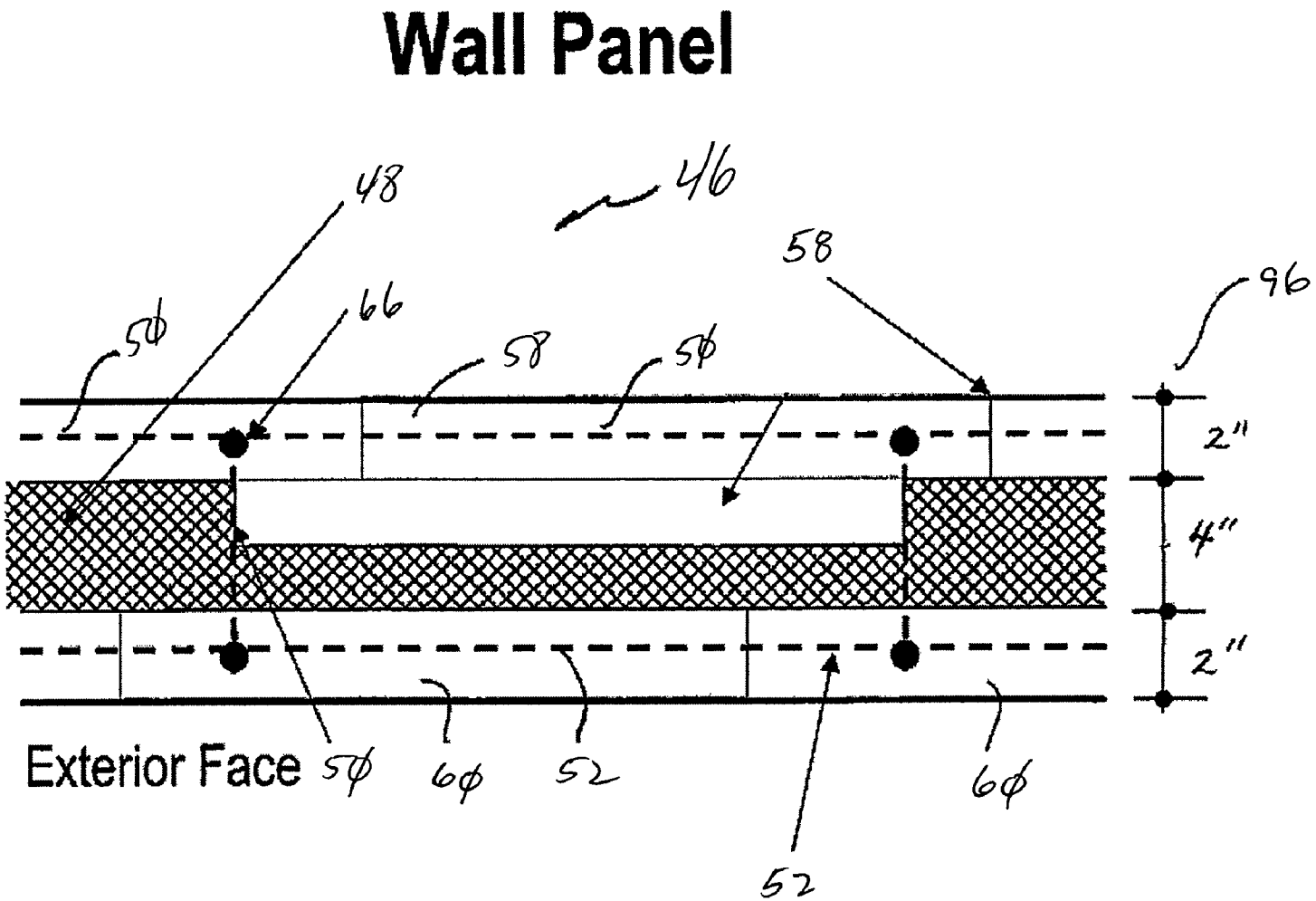
FIG. 22 is a cross-sectional top plan view of an alternative composite wall panel.

Referring now to FIG. 22, a cross-sectional of plan view of an alternative composite wall panel 2 is provided herein, and which further identifies a insulative core cut-out 78 which is used in combination with prestressed cable 66, and interior carbon fiber grid 50 and exterior carbon fiber grid 52. The carbon fiber grids are further embedded in an exterior concrete layer 60, an interior concrete layer 58, and which provide a strong wall panel for numerous construction applications. As further depicted in this drawing, the wall panel 2 has a width of about 50 inches, which includes a 2 inch layer of exterior concrete 60, a 2 inch layer of interior concrete 58, and a 4 inch layer of insulation core 4.

Figure 23:
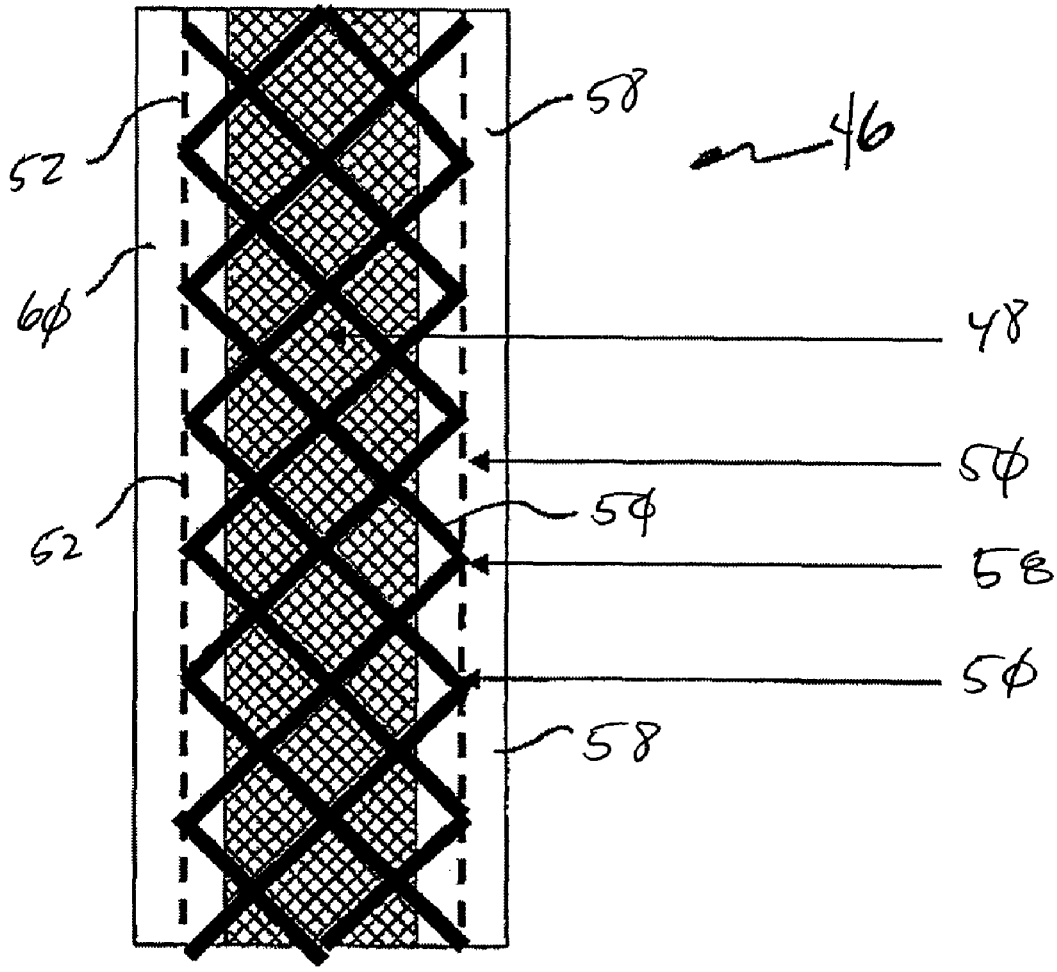
FIG. 23 is a cross-sectional front elevation view depicting the carbon fiber grid and other internal components taken at section BB of FIG. 20.

Referring now to FIG. 23, a cross-sectional front elevation view depicting the carbon fiber grid and other internal components taken at section BB of FIG. 20 is provided herein. More specifically, the interior carbon fiber grid 50 is shown extending substantially between an exterior concrete layer 60 to an interior concrete layer 58, and further interconnected to a exterior carbon fiber grid 52 and an interior carbon fiber grid 6. By utilizing these materials in combination with the lightweight insulated core 4, a lightweight, structurally reinforced wall panel can be constructed and transported in a cost effective manner.

Figure 24:
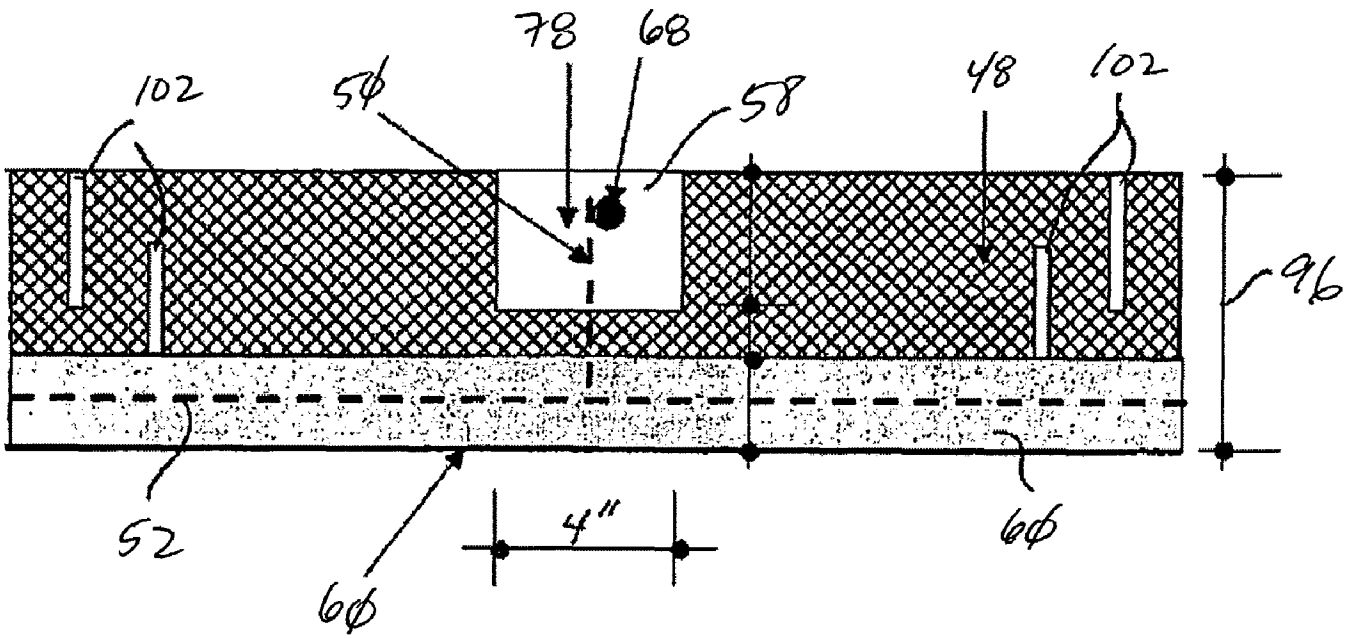
FIG. 24 is a cross-sectional top plan view showing a residential composite wall panel with a substantially square shaped cut out portion.

Referring now to FIG. 24, a cross-sectional top plan view is provided which depicts a multi-unit residential wall panel, and depicting a middle rib cut-out 78 provided herein. More specifically, the insulative cut-out 78 in this embodiment includes a substantially square shaped cut-out portion 78 which includes a interior concrete layer 58, a interior is carbon fiber grid 6, and one or more reinforcing bars 68 or pre-stressed cable. Preferably, the width of the insulative core cut-out 78 is about 4 inches, but as appreciated by one skilled in the art may be between about 2 and 10 inches as necessary. Furthermore, a plurality of expansion joint 102 may be provided herein to help maintain the structural integrity of the interior concrete layer 58 and the exterior concrete layer 60. Furthermore, the residential wall panel shown in FIG. 24 is designed to be less load bearing than some other embodiments of the present invention, and would generally be utilized for exterior or interior wall applications.

Figure 25:
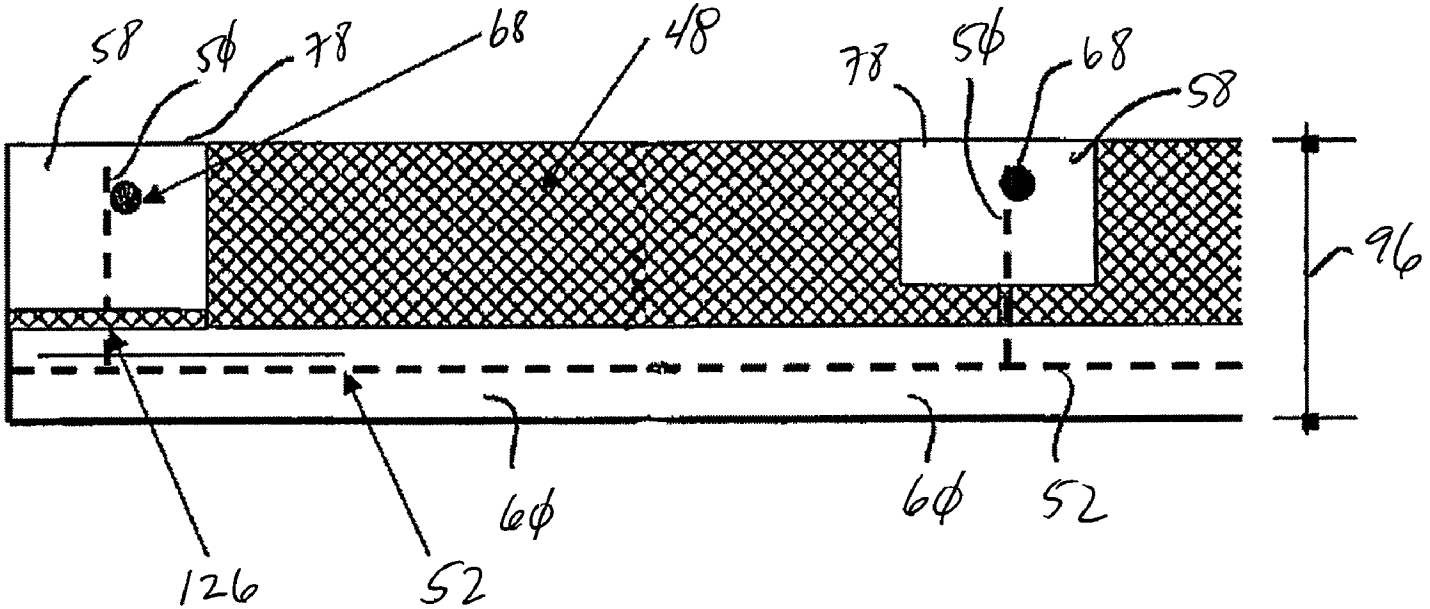
FIG. 25 is a cross-sectional top plan view of a residential composite wall panel shown at an end rib.

Referring now to FIG. 25, a cross-sectional top plan view of a residential composite wall panel shown at an rib is provided herein. More specifically, a substantially square end rib is shown adjacent to an end portion of the wall panel 2, and which includes an interior carbon fiber grid 6, at least one reinforcing bar 68, and a small layer of an insulative core material 78 which serves as a thermal break 126 between the interior concrete layer 58 and the exterior concrete layer 60.

Figure 26:
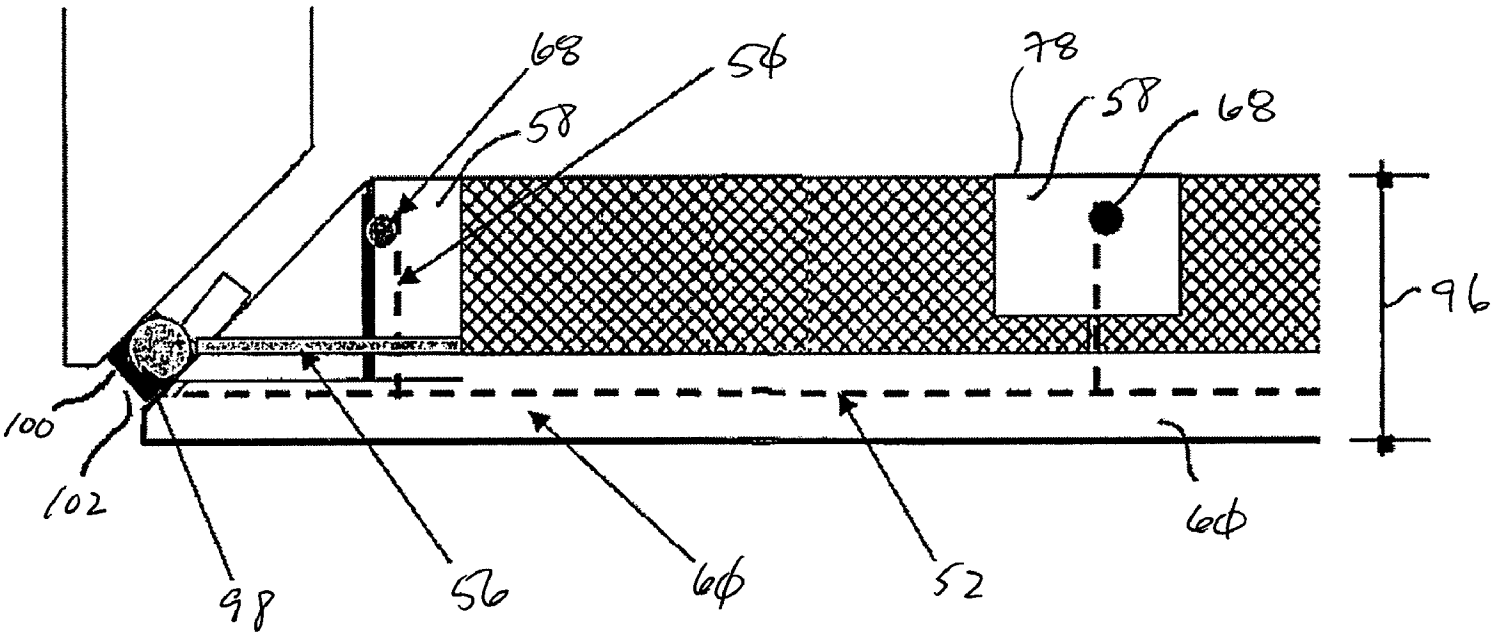
FIG. 26 is a cross-sectional top plan view of a residential composite building panel shown at a corner rib.

Referring now to FIG. 26, a cross-sectional top plan view of a residential composite building panel as shown at a corner rib is provided herein. More specifically, the interconnection of two composite building panels 2 are shown at a corner section, and which utilizes a foam rope 98 and caulking material for insulative purposes. The end sections utilize a insulative cut-out 78 which includes one or more interior carbon fiber grid 6, one or more reinforcing bars 68 or prestressed cable 66, and a thermal/vapor barrier 56. By utilizing the combination of these materials, additional structural integrity can be achieved at the corner sections between two composite building panels 2.

Figure 27:
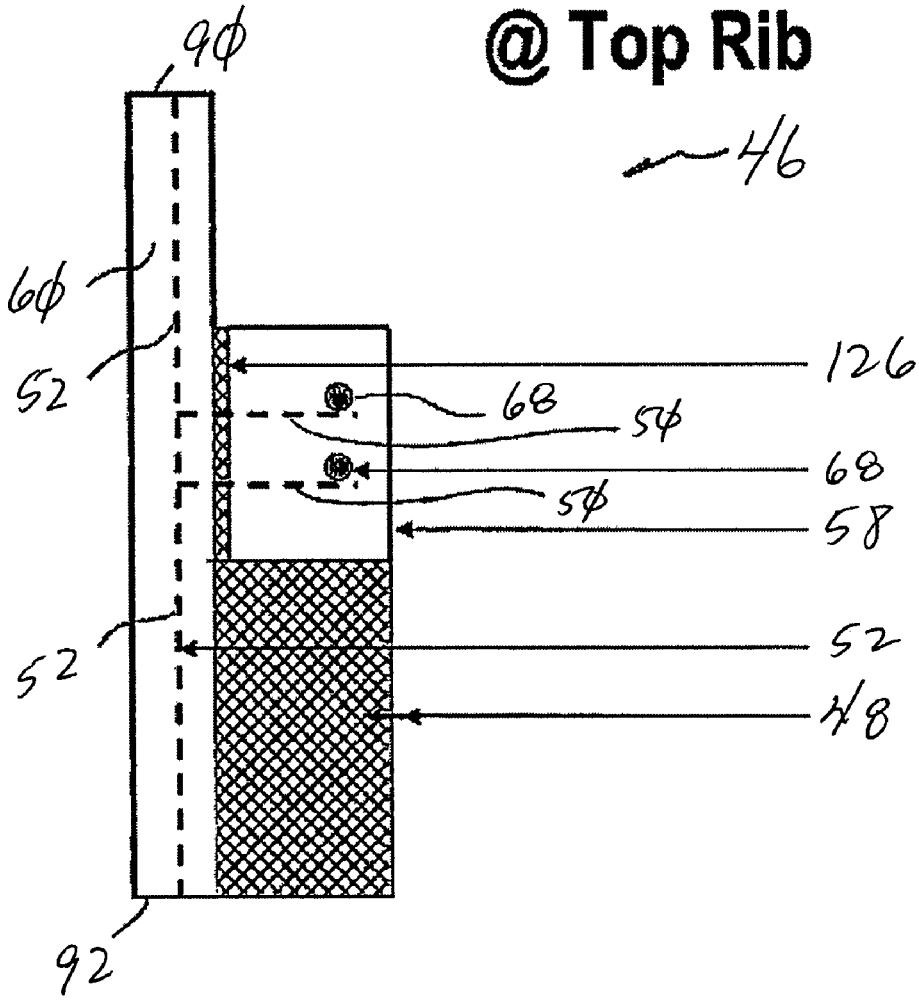
FIG. 27 is a cross-sectional front elevation view of a residential composite building panel shown at a top rib.

Referring now to FIG. 27, a cross-sectional front elevation view of a residential composite building panel shown at a top rib is provided herein. More specifically, the insulative core cut-out portion 78 includes one or more reinforcing bars 68 and a plurality of interior carbon fiber grids 50 which are interconnected to an exterior carbon fiber grid 52. As further depicted in FIG. 27, a thermal break 126 is provided with a one to two inch layer of insulated core material 4, and which is positioned between the exterior concrete layer 60 and the interior concrete layer 58. The notch created from the top of the building panel upper end 80 and the upper portion of the insulative core cut-out 78 may be utilized to support structural beams, floor joists or other structural members comprised of wood, concrete, steel or other well known materials used in residential or commercial construction.

Figure 28:
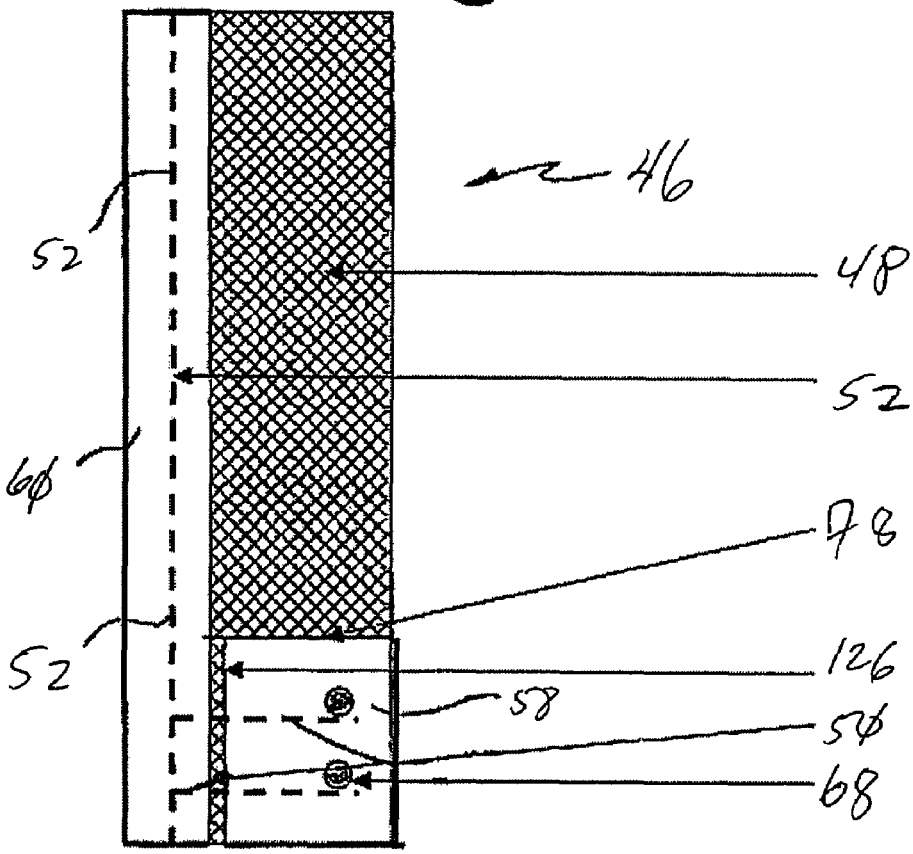
FIG. 28 is a cross-sectional front elevation view of a residential composite building panel shown at a bottom rib.

Referring now to FIG. 28, a cross-sectional front elevation view of a residential composite building panel shown at a bottom rib is provided herein. More specifically, the bottom rib comprises a insulative core cutout 78 which utilizes one or more reinforcing bars 68 or prestressed cables 66, and which are positioned within an interior concrete layer 58 and extending outwardly toward an exterior face and into an exterior concrete layer 60. As further shown, the exterior concrete layer 60 further comprises an exterior carbon fiber grid 52. By utilizing the insulative core cut-out 78 and other structural components described herein, structural integrity and strength is provided to the bottom rib of the residential panel, and which is capable of withstanding the loading requirements necessary in a residential wall panel and capable of compressive strengths of at least about 3500 psi.

In many of the embodiment of the present invention, the insulative core 48 is manufactured in a unique process with a plurality of carbon fibers strands 54 positioned in a ribbon/tape pattern 74 which extends through the insulative core 48 and which protrudes beyond both the interior and exterior surfaces to accommodate interconnection to the interior and exterior carbon fiber grids. Alternatively, metallic materials such as wire and mesh comprised of steel or other similar materials may also be used as appreciated by one skilled in the art.

A depiction of one embodiment of the carbon fiber strands 54 and their orientation and interconnection may be seen in FIG. 15. These carbon fiber strands 54 generally have a thickness of between about 0.05 inches to 0.4 inch, and more preferably a diameter of about 0.15 inches. As more typically referred to in the art, the carbon fiber strands 54 have a given "tow" size. The tow is the number of carbon strands, and may be in the example between about 12,000 48,000 individual strands, i.e., 12K to 48K tow. The intersection points of the carbon fiber strands which are required to make the tape pattern are interconnected with a strong resin such as a thermoset which is applied under a predetermined heat and pressure. In another embodiment, the individual strands of carbon fiber may be "woven" with other strands to create a stronger ribbon/tape material 74.

The carbon fiber strands 54 are interconnected to the interior carbon fiber grid 50 positioned substantially adjacent to the interior surface of the insulative core and with the exterior carbon fiber grid 52 positioned substantially adjacent the exterior surface of the insulative core 4. One example of a carbon fiber grid ribbon 74 which may be used in the present invention is the "MeC-GRID™" carbon fiber material which is manufactured by Hexcel Clark-Schwebel. The interior and exterior carbon grid tape is comprised generally of looped or crossed weft and warped strands, that run substantially perpendicular to each other and are machine placed on several main tape "stabilizing strands" that run parallel to the running/rolling direction of the tape. The carbon fiber tape is then used in a totally separate process by casting it transversely through the insulating core 4, to produce an insulated structural core panel that links together compositively the interior concrete layer 58 and exterior concrete layer 60 of the composite wall panel 2.

With regard to the concrete utilized in various embodiments of the present application, the interior wall may be comprised of a low density concrete such as Cret-o-Lite™, which is manufactured by Advanced Materials Company of Hamburg, N.Y. This is an air dried cellular concrete which is nailable, drillable, screwable, sawable and very fire resistant. In a preferred embodiment, the exterior concrete layer 60 is comprised of a dense concrete material to resist moisture penetration and in one embodiment is created using VISCO CRETE™ or equal product which is a chemical that enables the high slumped short pot life liquification of concrete to enable the concrete to be placed in narrow wall cavities with minimum vibration and thus create a high density substantially impermeable concrete layer. VISCO-CRETE™ is manufactured by the Sika Corporation, located in Lyndhurst, N.J. The exterior concrete layer 60 is preferably about ¾ to 2 inches thick, and more preferably about 1.25 inches thick. This concrete layer has a compression strength of approximately 5000 psi after 28 days of curing, and is thus extremely weather resistant.

In a preferred embodiment of the present invention, a vapor barrier material 56 may be positioned next to or on to the exterior surface of the insulative core 4, or alternatively on the interior surface of the insulative foam core 4. The vapor barrier 56 impedes the penetration of moisture and thus protects the foam core from harsh environmental conditions caused by temperature changes. Preferably, the vapor barrier 56 is comprised of a plastic sheet material, or other substantially impermeable materials that may be applied to the insulative core 48 during manufacturing of the foam core, or alternatively applied after manufacturing and prior to the pouring of the exterior concrete layer 60.

Positioned proximate to the carbon fiber sheer strip 74 is one or more reinforcing bar 80, which are generally "rebar" materials manufactured from carbon steel or other similar metallic materials. Preferably, the reinforcing bar 80 has a diameter of at least about 0.5 inches, and more preferably about 0.75-1.00 inches. As appreciated by one skilled in the art, the reinforcing bars 80 may be any variety of dimensions or lengths depending on the length and width of the building panel 2, and the strength requirements necessary for any given project. As additionally seen in FIG. 14, a third reinforcing bar 80 may additionally be positioned proximate to the wire mesh 82 adjacent the building panel interior surface 58 to provide additional strength and durability.

What is claimed is:

1. An insulative wall panel comprising:

a concrete exterior face wall having a thickness and having an upper edge, a lower edge, and lateral edges therebetween, said concrete exterior face wall having at least one carbon fiber strip extending between said lateral edges, said at least one carbon fiber strip being embedded completely within said thickness of said concrete exterior face wall wherein concrete that comprises said exterior face wall completely surrounds said at least one strip, said at least one strip having a width, thickness and length wherein said width is greater that said thickness;

a plurality of ribs extending from said concrete exterior face wall that are reinforced with a reinforcing rod and are operably interconnected to said concrete exterior face wall with a carbon fiber stirrup; and a plurality of insulation panels located adjacent to said plurality of ribs, thereby providing a lightweight, strong and highly insulative wall panel.

2. The insulative wall panel of claim 1, wherein said ribs extend from an inner surface of said concrete exterior face wall, and wherein said reinforcing rod is positioned substantially parallel to said lateral edges.

3. The insulative wall panel of claim 1, wherein said concrete exterior face wall and said plurality of ribs are comprised of at least a low density concrete.

4. The insulative wall panel of claim 1, wherein said reinforcing rod is comprised at least partially of a metallic material.

5. The insulative wall panel of claim 1, wherein said at least one carbon fiber stirrup is aligned substantially perpendicular to said concrete exterior face wall.

* * * * *